US010111515B2

(12) United States Patent
Kim

(10) Patent No.: US 10,111,515 B2
(45) Date of Patent: Oct. 30, 2018

(54) NUMBER OF BRISTLE FOR ANY SHAPE'S DISC BY MANO INJECTION MOLDING

(71) Applicant: AA R&D LLC, Leonia, NJ (US)

(72) Inventor: Yoon-Hoi Kim, Leonia, NJ (US)

(73) Assignee: AA R&D LLC, Leonia, NJ (US)

( * ) Notice: Subject to any disclaimer, the term of this patent is extended or adjusted under 35 U.S.C. 154(b) by 224 days.

(21) Appl. No.: 15/203,489

(22) Filed: Jul. 6, 2016

(65) Prior Publication Data

US 2018/0008028 A1 Jan. 11, 2018

(51) Int. Cl.

| | |
|---|---|
| ***A46B 3/10*** | (2006.01) |
| ***A46D 1/00*** | (2006.01) |
| ***A46B 7/04*** | (2006.01) |
| ***A46B 9/02*** | (2006.01) |

(52) U.S. Cl.

CPC ..... *A46B 3/10* (2013.01); *A46B 7/044* (2013.01); *A46B 9/021* (2013.01); *A46D 1/02* (2013.01); *A46B 7/046* (2013.01); *A46B 2200/1053* (2013.01)

(58) Field of Classification Search

CPC ..... A46B 3/10; A46B 7/044; A46B 9/021
USPC ..... 300/21
See application file for complete search history.

(56) References Cited

U.S. PATENT DOCUMENTS 2,496,010 A * 1/1950 Lotters ..... A46B 15/00 15/172
3,329,998 A 7/1967 Stohr
4,422,986 A * 12/1983 Cole ..... A46B 3/005 15/187
8,919,351 B1 12/2014 Wang
2009/0194128 A1* 8/2009 Vandromme ..... A46B 3/18 132/218
2010/0037911 A1* 2/2010 Kim ..... A45D 40/262 132/218
2015/0335133 A1 11/2015 Kim

FOREIGN PATENT DOCUMENTS

| | | | |
|---|---|---|---|
| JP | 3189729 | B2 | 7/2001 |
| JP | 2007-44528 | A | 2/2007 |
| JP | 2009-535078 | A | 10/2009 |
| JP | 2014-508017 | A | 4/2014 |
| WO | 02/07563 | A2 | 1/2002 |

(Continued)

OTHER PUBLICATIONS

Office Action dated Sep. 26, 2017, issued in counterpart Japanese Application No. 2016-154298, with English translation (15 pages).

(Continued)

*Primary Examiner* — Laura C Guidotti
(74) *Attorney, Agent, or Firm* — Westerman, Hattori, Daniels & Adrian, LLP

(57) ABSTRACT

A method for manufacturing a cosmetic applicator brush, where the cosmetic applicator brush comprises a plurality of discs assembled relative to one another, each disc having a body with a plurality of bristles extending radially therefrom, comprises the step of forming the cosmetic applicator brush by a mono-injection molding, wherein adjacent discs are maintained at an angular relationship with respect to one another independent of a disc specific keying element.

20 Claims, 69 Drawing Sheets

(56) References Cited

FOREIGN PATENT DOCUMENTS

| | | | |
|---|---|---|---|
| WO | 2007/125207 | A2 | 11/2007 |
| WO | 2010/147344 | A2 | 12/2010 |

OTHER PUBLICATIONS

Extended Search Report dated Dec. 8, 2017, issued in counterpart European Application No. 16001747.1 (7 pages).
Office Action dated Jan. 16, 2018, issued in counterpart Japanese Application No. 2016-154298, with English translation. (13 pages).

* cited by examiner

Fig. 28

| # | TOP | SIDE | OUTLINE | |
|---|---|---|---|---|
| | | X.M.M.L.L.L

Fig. 29

| | | | | |
|---|---|---|---|---|
| RB-007 | X.S.S.S.M.L.L.M.S.S.S.S.S.M.L.L.M.S.S.S | | | |
| RB-008 | X.S.M.S.M.S.M.S.M.S.M.S.M.S.M.S.M.S.M.S | | | |
| RB-009 | X.L.L.M.S.S.M.L.L.L.L.M.S.S.M.L.L.L.L.M.S. | | | |
| RB-010 | X.S.S.L.S.S.L.S.S.L.S.S.L.S.S.L.S.S.L.S.S | | | |
| RB-011 | X.S.S.S.S.S.M.M.L.L.L.L.L.L.L.L.M.M.S.S.S.S.S | | | |
| RB-012 | X.L.L.L.M.S.S.S.M.L.L.L.L.L.L.M.S.S.S.M.L.L.L | | | |

Fig. 30

| | | | | |
|---|---|---|---|---|
| RB-013 | X.L.L.L.L.L.M.M.S.S.S.S.S.S.S.S.M.M.L.L.L.L.L | | | |
| RB-014 | X.S.S.S.S.S.S.S.M.M.M.M.M.M.M.L.L.L.L.L.L.L | | | |
| RB-015 | X.L.L.L.L.L.L.L.M.M.M.M.M.M.M.S.S.S.S.S.S.S | | | |
| RB-016 | X.M.M.M.M.M.M.M.M.M.M.M.S.S.S.S.S.S.S.S.S.S.S | | | |
| RB-017 | X.L.L.M.M.M.M.M.M.M.M.M.S.S.S.S.S.S.S.S.S.S | | | |
| RB-018 | X.S.M.M.L.L.L.L.L.L.L.L.M.M.M.M.M.M.M.M.S.S | | | |

| | | | | |
|---|---|---|---|---|
| | X.L.L.L.L.L.L.L.M.M.S.S.S.M.M.L.L.L.L.L.L.L | | | |
| RB-025 |  |  |  |  |
| | X.L.L.M.M.M.M.M.M.M.S.S.M.M.M.M.M.M.M.L.L | | | |
| RB-026 |  |  |  |  |
| | X.S.S.S.S.S.S.S.S.S.S.S.S.S.S.S.S.S.M.M.L.L | | | |
| RB-027 |  |  |  |  |
| | X.L.L.L.L.L.L.L.L.L.L.L.L.L.L.L.L.L.M.M.S.S | | | |
| RB-028 |  |  |  |  |
| | X.L.L.M.M.S.S.S.S.S.S.S.S.S.S.S.S.S.S.S.S.S.S | | | |
| RB-029 |  |  |  |  |
| | X.S.S.S.S.S.S.S.S.M.M.S.M.M.S.S.S.S.S.S.S.S | | | |
| RB-030 |  |  |  |  |

Fig. 33

| | | | | |
|---|---|---|---|---|
| RB-031 | X.S.S.S.S.S.S.S.M.M.S.S.S.M.M.S.S.S.S.S.S.S | | | |
| RB-032 | X.S.S.S.S.S.S.M.M.S.S.S.S.S.M.M.S.S.S.S.S.S | | | |
| RB-033 | X.S.S.S.S.S.S.S.S.M.M.L.M.M.S.S.S.S.S.S.S.S | | | |
| RB-034 | X.S.S.S.S.S.S.S.M.M.L.L.L.M.M.S.S.S.S.S.S.S | | | |
| RB-035 | X.S.S.S.S.M.M.L.L.L.L.L.M.M.S.S.S.S.X | | | |
| RB-036 | X.L.M.S.M.L.M.S.M.L.M.S.M.L.M.S.M.L.M.S.M.L | | | |

Fig. 34

| | | | | |
|---|---|---|---|---|
| RB-037 | X.M.L.L.M.S.S.M.L.L.M.S.S.M.L.L.M.S.S.M.L.L | | | |
| RB-038 | X.S.S.M.L.L.L.L.M.S.S.M.L.L.L.L.M.S.S.M.L.L | | | |
| RB-039 | X.S.M.L.M.S.S.S.M.L.M.S.S.S.M.L.M.S.S.S.M.L | | | |
| RB-040 | X.S.S.S.M.M.M.L.L.L.M.M.M.S.S.S.M.M.M.L.L.L | | | |
| RB-041 | X.M.L.M.S.S.S.S.S.S.S.S.S.S.S.S.M.L.M.S | | | |
| RB-042 | X.S.M.L.L.M.M.S.S.S.S.S.S.S.S.M.M.L.L.M.S | | | |

Fig. 35

| | | | | |
|---|---|---|---|---|
| RB-043 | X.L.L.M.M.L.L.S.S.S.S.S.S.S.S.S.M.M.L.L.M.S | | | |
| RB-044 | X.S.S.M.M.S.S.S.S.M.M.L.L.L.L.L.M.M.S.S.S.S. | | | |
| RB-045 | X.S.S.M.M.L.L.L.S.S.S.S.S.S.L.L.L.M.M.S.S | | | |
| RB-046 | X.S.S.L.L.S.S.S.S.L.L.L.S.S.S.S.L.L.S.S.S.S | | | |
| RB-047 | X.S.S.S.S.S.M.M.M.M.M.M.M.M.M.M.M.S.S.S.S.S | | | |
| RB-048 | X.L.L.L.L.L.L.L.L.L.L.S.L.L.L.L.L.L.L.L.L.L | | | |

Fig. 36

| | | | | |
|---|---|---|---|---|
| RB-049 | X.S.S.S.S.S.S.S.S.S.S.L.S.S.S.S.S.S.S.S.S.S | | | |
| RB-050 | X.S.M.L.M.S.S.S.S.S.S.S.S.S.S.S.S.S.M.L.M.S | | | |
| RB-051 | X.S.S.S.M.M.M.M.M.M.M.M.M.M.M.M.S.S.S.S.S | | | |
| RB-052 | X.S.M.L.M.S | | | - |
| RB-053 | X.M.L.L.M.S | | | - |
| RB-054 | X.L.M.S.M.L | | | - |

| | | | | |
|---|---|---|---|---|
| RB-055 | X.L.L.M.S.M.L.L | | | |
| |  |  |  | - |
| RB-056 | X.L.S.M.S.L | | | |
| |  |  |  | - |
| RB-057 | X.S.M.M.L.L.L.M.M.S | | | |
| |  |  |  | - |
| RB-058 | X.M.L.L.S | | | |
| |  |  |  | - |
| RB-059 | X.L.M.S | | | |
| |  |  |  | - |
| RB-060 | X.S.S.S.L.L.L.L.L.L.L.L.L.L.L.L.L.L.S.S.S.S | | | |
| |  |  |  |  |

Fig. 38

| | | | | |
|---|---|---|---|---|
| RB-061 | X.M.M.M.L.L.L.L.L.L.L.L.L.L.L.L.L.L.L.S.S.S.S | | | |
| RB-062 | X.M.M.M.M.M.M.M.L.L.L.L.L.L.L.L.L.L.L.L.L.L.L | | | |
| RB-063 | X.M.M.L.M.L.M.L.M.L.M.L.M.L.M.S.M.S.M.S.M.S.M.S | | | |
| RB-064 | X.M.L.L.M.S.M.L.L.M.L.L.M.M.L.M.S.M.M.L.M.S | | | |
| RB-065 | X.S.S.S.M.L.L.L.L.L.M.S.S.S.M.L.L.L.L.L.M | | | |
| RB-066 | X.S.M.M.M.S.M.S.S.S.S.S.M.M.M.M.S.M.M.M.S.S | | | |

Fig. 39

| | | | | |
|---|---|---|---|---|
| RB-067 | X.L.M.S.S.S.S.S.S.M.L | | | - |
| RB-068 | X.S.S.L.L.M.M.M.M.L.L. | | | - |
| RB-069 | X.M.M.L.L.L.M.M.L.L.L.M.S | | | - |
| RB-070 | X.M.M.M.M.L.L.L.L.L.M.M.M.M.S.S | | | - |
| RB-071 | X.L.L.M.M.M.M.L.L.L.M.M.M.M.L.L.S.S | | | - |
| RB-072 | X.M.M.M.M.L.L.L.L.L.L | | | - |

Fig. 40

| | | | | |
|---|---|---|---|---|
| RB-073 | X.L.L.L.L.L.L.L.L.M.M.M.M.S.S.S.S | | | |
| RB-074 | X.M.L.L.L.M.S.S.S.S.M.L.L.L.M.S.S | | | |
| RB-075 | X.M.M.L.L.L.M.M.S.S.S.S.S.S.S.S.S.S | | | |
| RB-076 | X.S.S.L.L.L.M.M.M.L.L.L.L.L.M.M.M.L.L.L.S.S | | | |
| RB-077 | X.M.M.M.L.L.L.L.L.L.L.L.L.L.L.L.L.M.M.M.S.S | | | |
| RB-078 | X.L.M.S.M.L.L.L.M.S.M.L.L.L.M.S.M.L.L.L.M.S | | | |

Fig. 41

| | | | | |
|---|---|---|---|---|
| RB-079 | X.S.M.L.L.L.L.L.L.M.S.L.L.M.L.L.M.L.L.S.S.S | | | |
| RB-080 | X.S.S.M.M.M.L.L.M.S.M.L.L.L.M.M.S.M.L.L.M.S | | | |
| RB-081 | X.S.M.L.L.L.L.L.L.L.L.L.L.M.M.M.S.S.S.S.S | | | |
| RB-082 | X.S.L.L.M.L.L.L.L.M.S.L.L.M.L.L.M.L.L.S.S.S | | | |
| RB-083 | X.M.M.M.L.L.L.L.L.L.L.L.L.L.L.L.M.M.M.S.S | | | |
| RB-084 | X.S.L.L.M.S.L.L.M.S.L.L.M.S.L.L.M.S.L.L.M.S | | | |

Fig. 42

| | | | | |
|---|---|---|---|---|
| RB-085 | X.M.L.M.S.M.S.L.L.L.M.L.L.L.S.M.S.M.L.M.X | | | |
| RB-086 | X.S.L.M.L.S.L.M.L.S.L.M.L.S.L.M.L.S.L.M.L.S | | | |
| RB-087 | X.S.M.S.M.S.M.S.M.L.M.S.M.L.L.M.L.L.M.S.S | | | |
| RB-088 | X.S.L.M.S.S.M.L.M.L.M.S.M.L.M.L.M.S.S.M.L.S | | | |
| RB-089 | X.S.S.M.L.L.L.M.L.M.S.M.L.L.S.L.L.S.L.L.M.S | | | |
| RB-090 | X.S.S.S.S.M.M.M.M.M.L.L.L.L.L.L.L.L.L.L.L | | | |

Fig. 43

| | | | | |
|---|---|---|---|---|
| RB-091 | X.S.S.S.M.L.L.L.M.S.S.S.M.L.L.L.M.S.S.S.S.S | | | |
| RB-092 | X.S.S.S.M.L.L.L.M.S.S.S.S.S.S.S.S.S.S.S.S.S | | | |
| RB-093 | X.M.L.L.L.M.S.S | | | |
| RB-094 | X.M.L.M.S.S.M.L.M.S.S.M.L.M.S.S.M.L.M.S.S.S | | | |
| RB-095 | X.M.L.L.L.M.S.S.S.S.S.S.S.S.S.S.S.S.S.S.S.S | | | |
| RB-096 | X.M.L.M.S.M.L.M.L.M.L.M.S.M.L.M.L.M.L.M.S.M | | | |

Fig. 44

| | | | | |
|---|---|---|---|---|
| RB-097 | X.S.M.L.M.S.S.M.L.M.L.L.L.M.L.M.S.S.M.L.M.S | | | |
| RB-098 | X.M.L.L.L.M.S.S.S.S.S.S.S.S.S.S.M.M.L.L.L.L | | | |
| RB-099 | X.S.M.S.L.S.L.S.L.S.M.S.M.S.L.S.L.S.L.S.M.S | | | |
| RB-100 | X.L.M.L.L.L.M.L.S.L.M.L.L.L.M.L.S.L.M.L.L.L | | | |
| RB-101 | X.S.S.L.S.M.M.L.M.S.M.L.L.L.L.L.M.S.M.L.M.M.S.L.S.X | | | |
| RB-102 | X.S.M.L.L.L.L.L.L.L.L.L.L.L.S.M.L.L.L.L.L.L.L.L.L.L | | | |

Fig. 45

| | | | | |
|---|---|---|---|---|
| RB-103 | X.S.M.L.M.S.M.L.M.S.M.L.M.S.M.L.M.S. | | | |
| RB-104 | X.S.M.L.M.S.S.M.M.L.L.M.M.S.S.M.M.L.L.L.M.S.X | | | |
| RB-105 | X.S.S.S.S.M.M.M.M.L.L.L.L.L.M.M.M.M.S.S.S.S.X | | | |
| RB-106 | X.S.S.M.M.L.L.M.M.S.S.S.S.S.M.M.L.L.M.M.X | | | |
| RB-107 | X.S.M.L.M.S.M.L.L.L.L.L.L.L.L.M.S.M.L.M.S.X | | | |
| RB-108 | X.L.L.L.L.M.M.M.M.S.S.S.S.M.M.M.M.L.L.L.L.X | | | |

Fig. 46

| | | | | |
|---|---|---|---|---|
| RB-109 | X.L.M.M.M.M.S.S.S.M.L.L.M.S.S.S.M.M.M.M.L.X | | | |
| RB-110 | X.S.S.S.M.M.M.M.L.L.L.L.M.S.M.L.L.L.L.M.M.M.M.S.S.S.X | | | |
| RB-111 | X.S.S.M.M.M.L.M.L.M.S.S.M.L.M.S.S.M.L.M.L.M.M.M.S.S.X | | | |
| RB-112 | X.M.M.L.L.M.M.S.S.S.S.S.S.S.S.M.M.L.L.M.M.X | | | |
| RB-113 | X.M.M.L.L.M.M.S.S.M.M.L.M.M.S.S.M.M.L.L.M.M.X | | | |
| RB-114 | X.S.S.M.M.L.L.M.M.S.S.L.S.S.M.M.L.L.M.M.S.S.X | | | |

Fig. 47

| | | | | |
|---|---|---|---|---|
| RB-115 | X.S.S.M.L.M.S.S.S.S.M.L.M.S.S.S.S.M.L.M.S.S.X | | | |
| RB-116 | X.L.M.L.L.L.M.L.M.L.M.S.S.L.S.S.M.L.M.L.L.L.M.L.X | | | |
| RB-117 | X.L.L.L.M.L.L.L.M.L.M.L.L.L.L.L.M.L.M.L.L.L.M.L.L.L.X | | | |
| RB-118 | X.M.M.L.L.L.M.L.L.L.S.L.M.L.M.L.S.L.L.L.M.L.L.L.M.M.X | | | |
| RB-119 | X.S.S.M.M.M.L.L.M.L.L.L.L.S.L.L.L.L.M.L.L.M.M.M.S.S.X | | | |
| RB-120 | X.S.L.S.L.M.L.M.M.L.L.L.S.S.S.L.L.L.M.M.L.M.L.S.L.S.X | | | |

Fig. 48

| | | | | |
|---|---|---|---|---|
| RB-121 | X.S.S.S.L.L.L.S.L.L.S.L.S.M.S.L.S.L.L.S.L.L.L.S.S.S.X | | | |
| RB-122 | X.M.M.M.L.L.L.M.L.S.S.S.L.M.L.S.S.S.L.M.L.L.L.M.M.M.X | | | |
| RB-123 | X.S.S.M.M.L.L.L.L.M.S.S.M.L.M.S.S.M.L.L.L.L.M.M.S.S.X | | | |
| RB-124 | X.S.S.M.M.M.M.L.L.M.S.L.S.M.L.L.M.M.M.M.S.S.X | | | |
| RB-125 | X.L.M.M.S.S.S.S.S.M.L.L.M.S.S.S.S.S.M.M.L.X | | | |
| RB-126 | X.S.M.L.M.S.S.M.L.M.S.M.M.L.M.M.S.M.L.M.S.S.M.L.M.S.X | | | |

Fig. 49

| | | | | |
|---|---|---|---|---|
| RB-127 | X.S.S.M.M.S.S.S.S.M.M.L.L.L.L.L.M.M.S.S.S.X | | | |
| RB-128 | X.S.M.M.S.S.S.M.M.L.L.L.L.M.M.S.S.S.M.M.S.X | | | |
| RB-129 | X.S.M.L.S.S.S.S.S.S.S.S.S.S.S.S.S.L.M.S.X | | | |
| RB-130 | X.S.M.L.S.S.S.S.S.S.S.L.S.S.S.S.S.S.S.L.M.S.X | | | |
| RB-131 | X.S.M.L.M.S.S.S.S.S.M.L.M.S.S.S.S.S.M.L.M.S.X | | | |
| RB-132 | X.M.L.L.L.M.S.M.L.L.L.L.L.L.L.L.M.S.M.L.L.L.M.X | | | |

Fig. 50

| | | | | |
|---|---|---|---|---|
| RB-133 | X.S.S.S.M.L.M.S.S.M.L.L.L.M.S.S.M.L.M.S.S.S.X | | | |
| RB-134 | X.S.M.L.L.M.M.S.M.L.M.S.M.L.M.S.M.M.L.L.M.S.X | | | |
| RB-135 | X.M.L.L.M.S.S.S.S.M.L.L.L.M.S.S.S.S.M.L.L.M.X | | | |
| RB-136 | X.S.S.M.M.L.L.L.L.S.S.S.S.S.L.L.L.L.M.M.S.S.X | | | |
| RB-137 | X.M.M.S.S.S.M.S.M.L.L.M.S.L.S.M.L.L.M.S.M.S.S.S.M.M.X | | | |
| RB-138 | X.S.M.L.L.S.S.S.S.S.S.S.S.S.S.S.S.S.L.L.M.S.X | | | |

Fig. 51

| | | | | |
|---|---|---|---|---|
| RB-139 | X.S.S.S.S.S.M.M.L.L.L.L.L.L.M.M.S.S.S.S.S.X | | | |
| RB-140 | X.S.M.L.L.L.M.S.M.S.M.S.M.S.M.S.M.L.L.L.M.S.X | | | |
| RB-141 | X.S.M.L.L.L.M.M.S.S.L.L.S.S.M.M.L.L.L.M.S.X | | | |
| RB-142 | X.M.M.S.S.S.M.M.L.L.L.L.L.L.M.M.S.S.S.M.M.X | | | |
| RB-143 | X.M.L.M.S.M.L.L.L.M.S.S.M.L.L.L.M.S.M.L.M.X | | | |
| RB-144 | X.M.M.M.M.M.L.L.L.L.S.S.L.L.L.L.M.M.M.M.M.X | | | |

Fig. 52

| | | | | |
|---|---|---|---|---|
| RB-145 | X.M.L.M.S.S.S.M.L.L.L.L.L.L.M.S.S.S.M.L.M.X | | | |
| RB-146 | X.M.M.M.M.S.S.S.S.S.M.L.M.S.S.S.S.S.M.M.M.M.X | | | |
| RB-147 | X.S.S.S.S.L.S.S.S.S.L.L.S.S.S.S.L.S.S.S.S.X | | | |
| RB-148 | X.S.S.S.S.M.S.S.S.S.M.M.S.S.S.S.M.S.S.S.S.X | | | |
| RB-149 | X.S.S.S.S.M.L.L.L.L.M.M.L.L.L.L.M.S.S.S.S.X | | | |
| RB-150 | X.L.L.L.L.M.S.S.S.S.M.M.S.S.S.S.M.L.L.L.L.X | | | |

Fig. 53

| | | | | |
|---|---|---|---|---|
| RB-151 | X.M.M.L.L.M.S.S.S.M.L.M.S.L.S.M.L.M.S.S.S.M.L.L.M.M.X | | | |
| RB-152 | X.S.S.S.S.M.L.M.L.M.L.M.L.M.L.M.L.M.L.M.L.M.S.S.S.S.X | | | |
| RB-153 | X.M.M.M.M.L.L.L.M.L.M.L.M.L.M.L.M.L.M.L.L.L.S.S.S.S.X | | | |
| RB-154 | X.S.S.S.S.L.L.M.S.M.S.L.M.S.M.L.S.M.S.M.L.L.S.S.S.S.X | | | |
| RB-155 | X.S.M.L.S.S.S.S.M.L.M.L.M.L.M.L.M.L.M.S.S.S.S.L.M.S.X | | | |
| RB-156 | X.L.L.L.L.M.M.M.S.M.S.M.S.M.S.M.S.M.S.M.M.M.L.L.L.L.X | | | |

Fig. 54

| | | | | |
|---|---|---|---|---|
| RB-157 | X.L.L.L.L.M.M.M.S.M.S.M.L.L.L.M.S.M.S.M.M.M.L.L.L.L.X | | | |
| RB-158 | X.S.S.S.S.S.S.S.L.L.L.M.L.M.L.M.L.L.L.S.S.S.S.S.S.S.X | | | |
| RB-159 | X.S.S.S.S.S.S.M.M.M.M.L.M.S.M.L.M.M.M.M.S.S.S.S.S.S.X | | | |
| RB-160 | X.S.S.S.M.M.M.L.L.M.M.S.S.S.M.M.L.L.L.M.M.M.S.S.S.X | | | |
| RB-161 | X.S.S.S.M.M.M.L.L.M.M.S.S.L.S.S.M.M.L.L.M.M.M.S.S.S.X | | | |
| RB-162 | X.S.S.S.M.M.M.L.L.L.L.S.M.L.M.S.L.L.L.L.M.M.M.S.S.S.X | | | |

Fig. 55

| | | | | |
|---|---|---|---|---|
| RB-163 | X.S.S.S.S.S.M.L.M.S.M.L.M.S.M.L.M.S.M.L.M.S.S.S.S.S.X | | | |
| RB-164 | X.M.M.M.S.M.L.L.M.M.S.S.M.M.L.L.M.S.M.M.M.X | | | |
| RB-165 | X.M.M.M.S.M.L.L.L.M.M.S.M.M.L.L.L.M.S.M.M.M.X | | | |
| RB-166 | X.M.M.M.S.M.L.S.M.L.L.L.L.M.L.L.L.L.M.S.L.M.S.M.M.M.X | | | |
| RB-167 | X.M.M.M.L.M.S.L.M.S.S.L.L.S.L.L.S.S.M.L.S.M.L.M.M.M.X | | | |
| RB-168 | X.M.M.M.M.S.S.S.S.L.L.M.M.S.M.M.L.L.S.S.S.S.M.M.M.M.X | | | |

Fig. 56

| | | | | |
|---|---|---|---|---|
| RB-169 | X.M.M.M.M.M.M.M.S.L.S.L.S.L.S.L.S.L.S.M.M.M.M.M.M.M.X | | | |
| RB-170 | X.M.M.M.S.L.L.L.S.S.L.L.L.M.L.L.L.S.S.L.L.L.S.M.M.M.X | | | |
| RB-171 | X.L.L.L.M.M.S.S.S.M.M.L.L.L.L.L.M.M.S.S.S.M.M.L.L.L.X | | | |
| RB-172 | X.L.L.L.L.L.L.M.M.S.S.M.M.L.M.M.S.S.M.M.L.L.L.L.L.L.X | | | |
| RB-173 | X.L.L.L.L.M.M.S.S.M.L.M.L.S.L.M.L.M.S.S.M.M.L.L.L.L.X | | | |
| RB-174 | X.L.L.L.M.M.S.M.L.M.L.M.L.S.L.M.L.M.L.M.S.M.M.L.L.L.X | | | |

Fig. 57

| | | | | |
|---|---|---|---|---|
| RB-175 | X.L.L.M.M.S.M.L.M.S.M.L.L.L.L.L.M.S.M.L.M.S.M.M.L.L.X | | | |
| RB-176 | X.S.S.M.M.L.L.L.L.L

Fig. 58

| | | | | |
|---|---|---|---|---|
| RB-181 | X.S.M.M.M.M.L.S.S.M.L.M.S.L.S.M.L.M.S.S.L.M.M.M.M.S.X | | | |
| RB-182 | X.M.M.M.L.L.L.S.S.M.M.L.L.L.L.L.M.M.S.S.L.L.L.M.M.M.X | | | |
| RB-183 | X.M.L.M.S.S.S.M.L.L.L.S.S.L.S.S.L.L.L.M.S.S.S.M.L.M.X | | | |
| RB-184 | X.M.M.M.L.M.S.M.L.S.L.S.L.S.L.S.L.S.L.M.S.M.L.M.M.M.X | | | |
| RB-185 | X.S.S.M.M.L.L.L.L.M.S.L.S.L.S.L.S.M.L.L.L.L.M.M.S.S.X | | | |
| RB-186 | X.S.M.L.S.L.S.L.S.L.S.M.M.L.M.M.S.L.S.L.S.L.S.L.M.S.X | | | |

Fig. 59

| | | | | |
|---|---|---|---|---|
| RB-187 | X.S.S.S.M.M.L.L.L.M.M.S.S.S.S.S.M.M.L.L.L.M.M.S.S.S.X | | | |
| RB-188 | X.S.M.L.M.M.M.M.M.S.S.S.S.S.S.S.S.S.M.M.M.M.M.L.M.S.X | | | |
| RB-189 | X.M.M.L.M.S.M.L.L.M.S.L.L.M.L.L.S.M.L.L.M.S.M.L.M.M.X | | | |
| RB-190 | X.M.M.L.L.L.M.S.S.S.M.L.L.M.L.L.M.S.S.S.M.L.L.L.M.M.X | | | |
| RB-191 | X.M.S.M.L.M.S.S.M.L.L.L.M.S.M.L.L.L.M.S.S.M.L.M.S.M.X | | | |
| RB-192 | X.M.S.M.S.M.L.M.L.L.L.M.S.L.S.M.L.L.L.M.L.M.S.M.S.M.X | | | |

Fig. 60

| | | | | |
|---|---|---|---|---|
| RB-193 | X.M.M.S.S.S.M.M.L.L.L.L.M.L.M.L.L.L.L.M.M.S.S.S.M.M.X | | | |
| RB-194 | X.M.M.M.S.S.L.L.S.S.S.L.L.L.L.L.L.S.S.S.L.L.S.S.M.M.M.X | | | |
| RB-195 | X.M.L.M.S.S.S.M.L.M.S.L.S.L.S.L.S.M.L.M.S.S.S.M.L.M.X | | | |
| RB-196 | X.S.S.S.M.S.M.L.L.M.S.M.S.M.S.M.L.L.M.S.M.S.S.S.X | | | |
| RB-197 | X.S.S.L.M.S.M.L.M.S.L.L.M.S.M.L.L.S.M.L.M.S.M.L.S.S.X | | | |
| RB-198 | X.S.M.L.M.S.M.L.M.S.L.L.L.M.L.L.L.S.M.L.M.S.M.L.M.S.X | | | |

NUMBER OF BRISTLE FOR ANY SHAPE'S DISC BY MANO INJECTION MOLDING

FIELD OF THE INVENTION

The present invention relates to a cosmetic applicator. More particularly, the present invention relates to a manufacturing method for a cosmetic applicator brush including stacked discs which are angularly offset relative to one another independent of a central rod.

BACKGROUND OF THE INVENTION

Various cosmetics are applied using an applicator brush, for example, mascara which is a kind of cosmetic that is mainly used by women. The applicator brush is a cosmetic tool for painting various colors of mascara on eyelashes in order to show aesthetic sense around eyes or for applying other cosmetics to the eyes or other areas.

With the exemplary mascara, the applicator brush is configured to be inserted into a vessel in which mascara liquid is stored, a knob for opening and closing the vessel, a rod protruded to a leading end of the knob, and a brush formed on the rod. The mascara is used by smearing the mascara liquid on the brush through the coupling or separate process of the knob and the vessel.

Meanwhile, the mascara brush formed as above is manufactured to be suitable for various functions, such as a volume for the eyelashes (volume: effect that eyebrows are seen to be affluent according to the length and form of the brush hair), curl (curl: an effect that a length of eyebrows is long), clean (clean: an effect that eyebrows are not lumped), etc. The mascara brush uniformly applies the mascara liquid having viscosity on the eyelashes and a combing function by the brush should be excellent so that the eyelashes are not coagulated.

The applicator is composed of a bottle that contains the mascara composition and brush when not in use. A rod extends from an inner cavity of a holder, to which the holder acts as a gripping point for the user and doubles as a twist-top lid for the bottle, and finally the brush is made up of multiple supports that stack one on top of the other and align along the axis of the rod. Each support carries multiple protrusions that project radially outward along the outer perimeter of each support. The supports are stacked in such a way as described in U.S. Patent Application Publication Nos. 2010/0037911 and 2002/0059942 and U.S. Pat. No. 8,091,562.

One type of manufacture for mascara brushes is a disc brush which is manufactured with an axial rod that penetrating multiple discs in the center. In order to create a desired bristle arrangement, each successive disc is placed in angular offset compared to the disc before and after. To achieve the angular offset, a geometrical cross section or key is typically built into the rod and discs alike. Such a keyed system requires the key to be offset relative to the bristles a different amount for each disc.

It is known that mascara applicators of the conventional type consisted of a twisted wire core with a plurality of nylon fibers that protrude radially outward, as described in U.S. Patent Application Publication No. 2005/0133056.

Problem to be Solved

Although these applicators may have advantages in applying mascara to the eyelashes as opposed to traditional mascara applicators, they still have problems in that their brushes are not versatile (not being able to provide the effect of lengthening-volumizing-thinning all at once), there are more needs for design outputs for mix and match possibilities, and their brushes need to be more tuned for the user preference (i.e., thin, thick, wavy, and straight). As such, there is always an urgent need to find improved methods for manufacturing a cosmetic applicator.

SUMMARY OF THE INVENTION

An object of the present invention is to provide an applicator brush that is far superior in functionality, versatility and design, further improving on its capabilities.

In at least one embodiment, the present invention provides a method for manufacturing a cosmetic applicator brush, where the cosmetic applicator brush comprises a plurality of discs assembled relative to one another, each disc having a body with a plurality of bristles extending radially therefrom, comprising the step of: forming the cosmetic applicator brush by a mono-injection molding, wherein adjacent discs are maintained at an angular relationship with respect to one another independent of a disc specific keying element.

In at least one embodiment, the present invention provides a method for manufacturing a cosmetic applicator brush, where a number of the plurality of bristles is greater than or equal to three.

In at least one embodiment, the present invention provides a method for manufacturing a cosmetic applicator brush, where the plurality of bristles are placed and extended radially from any positions in each of the plurality of discs.

In at least one embodiment, the present invention provides a means for a brush that is multi-functional, improves design qualities, and allows for a more user defined specification. The presentation invention can be characterized by the brush's core, the brush consisting of at least three independent support members being stacked in succession to one another along the axis of the core, followed by protrusion that project radially and perpendicularly to the axis of the core, along the outer perimeter of the support. The arrangement of stacked successive supports along the core's axis allow for a multitude of design capabilities, particularly on the arrangement of bristles along a brush's core, allowing for more control of users preference on makeup outcome. In the present invention, each of these projections can be described as protrusions, such as is identified in. Each support carries multiple protrusions, in which each protrusion may or may not align with protrusions of the successive support.

In at least one embodiment, the present invention, although not limited to, uses a similar wire core to secure each support member to form the brush. Each support has a top-end face, a bottom-end face, and a side face which can be of any particular shape, whether it be a cylindrical shape or taking form of a polygon when viewed perpendicular to the axis.

In at least one embodiment, an applicator brush utilized as a cosmetic applicator for the eyelashes can be characterized by its stem, whereas at least two supports will be stacked in succession to one another. Each support contains at least two projections that form bases on the outer perimeter of each support.

In at least one embodiment, the bases form an irregular shape. This irregularity allows for eyelashes to be more effectively separated when applying cosmetic fluid to the eyelashes, allowing for a thin application of fluid to the eyelashes.

In at least one embodiment, the bases form a pyramid or a multi-peak wave. This embodiment allows for the possibility for an increased amount cosmetic fluid to be withheld by the brush as opposed to the previous embodiment. This embodiment also provides cavities within the brush for cosmetic fluid to be withheld for optimal application and spread of composition to the eyelashes in excess. This excess of application will provide a lengthening or volumizing effect.

In at least one embodiment, the bases take in the shape of a diamond or rhombus. The arrangement of the bases in this embodiment forms cavities as the previous embodiment, but form smaller cavities.

In at least one embodiment, the bases form an arrow.

In at least one embodiment, the bases form a "crisscross" with intersections at least 180° in separation.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIGS. 28-61 are examples of the applicator brush with various designs.

DETAILED DESCRIPTION OF THE INVENTION

Figure 1:
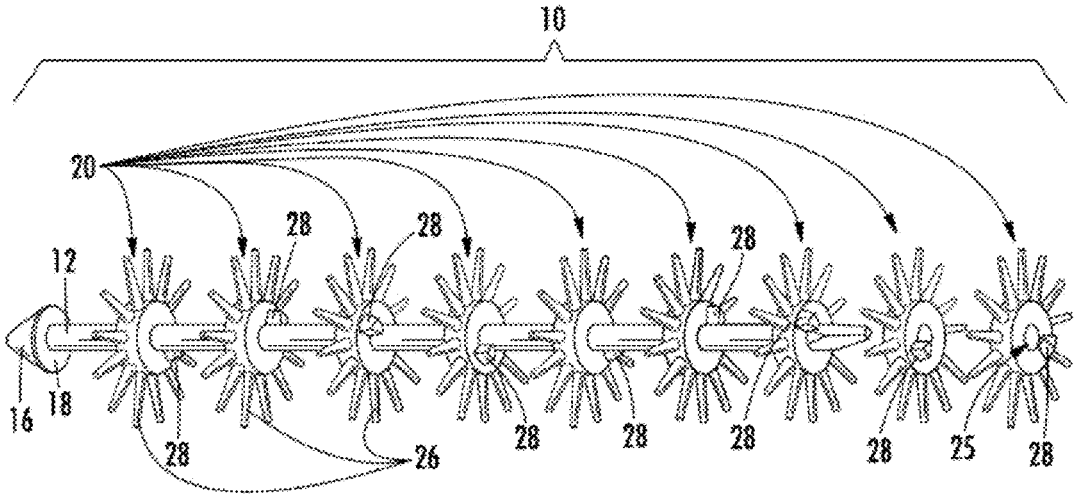
FIG. 1 is an exploded perspective view of a cosmetic applicator brush utilizing discs in accordance with an exemplary embodiment.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
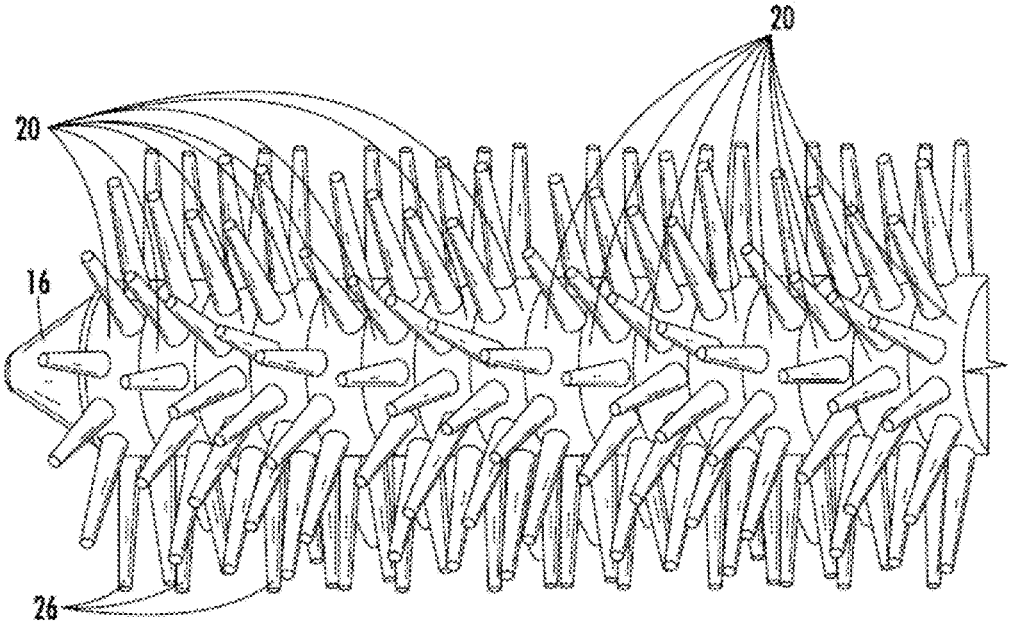
FIG. 2 is an assembled view of the cosmetic applicator brush of FIG. 1.

Referring to FIGS. 1-4, a cosmetic applicator brush 10 in accordance with an embodiment of the invention will be described. The applicator brush 10 includes a plurality of discs 20 assembled on a rod 12. In the illustrated embodiment, the rod 12 has a connection end 14, configured for connection to a knob, and a cap end 16 configured to provide a finished end to the applicator brush 10. A projection 18 extends from an inside surface of the cap end 16 and is configured to engage an indentation 30 of one of the discs 20 as explained below. While the cap end 16 of the illustrated embodiment has a projection, it is recognized that the cap end 16 may have an indentation configured to engage a projection 28 of one of the discs 20. It is noted that the rod 12 has a non-keyed configuration. Even without the rod having a keyed configuration, the discs 20 may be positioned on the rod 12 such that the bristles 26 have a desired configuration, for example, the twisted bristle path BP as illustrated in FIG. 2.

Figure 3:
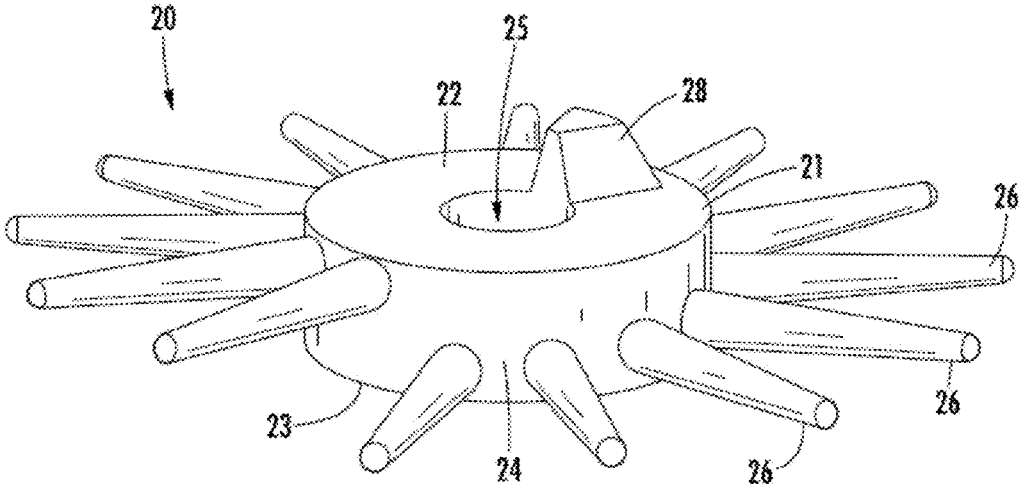
FIG. 3 is a top perspective view of an exemplary disc of the applicator brush of FIG. 1.
Figure 4:
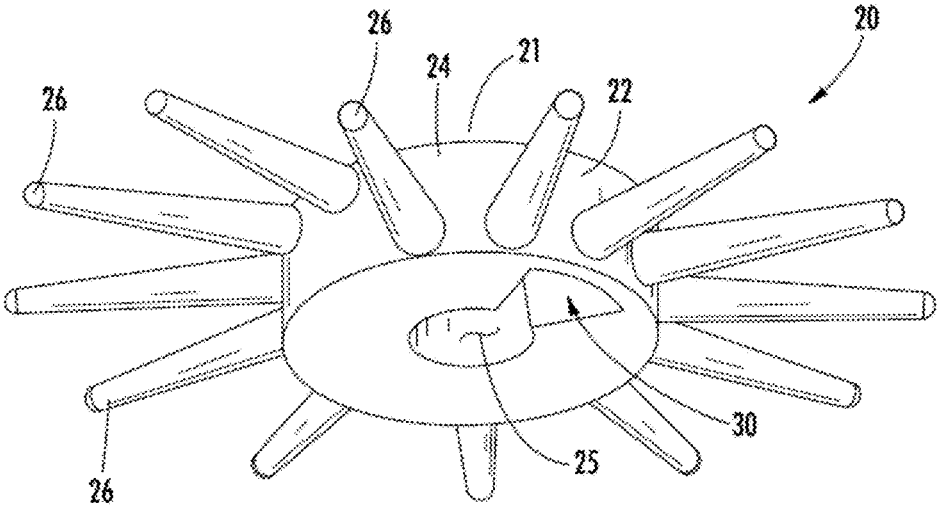
FIG. 4 is a bottom perspective view of the disc of FIG. 3.
Figure 5:
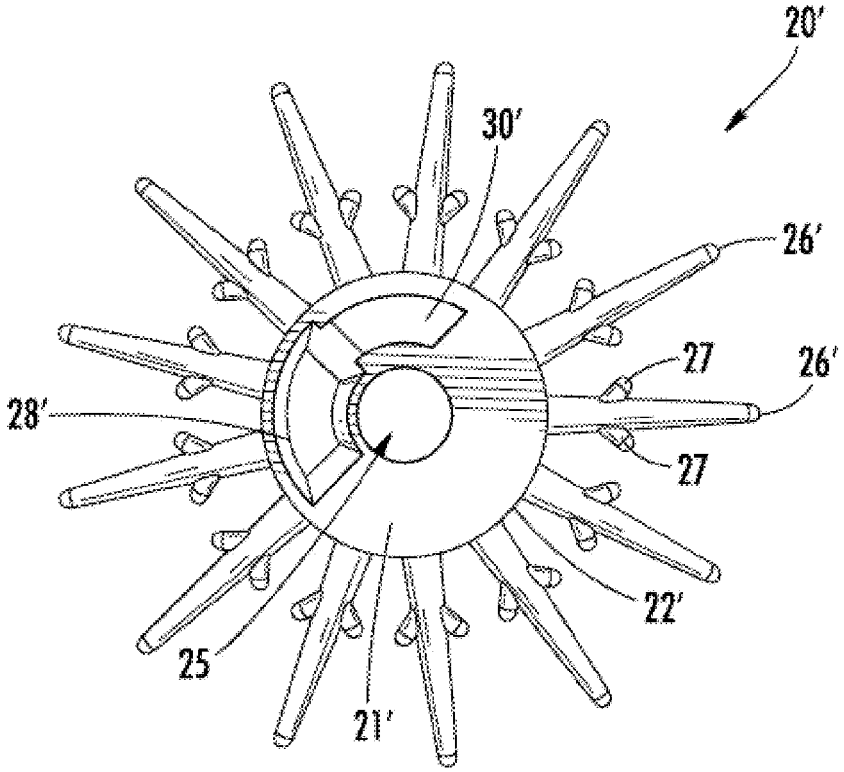
FIG. 5 is a top plan view of an exemplary disc in accordance with another embodiment of the invention.
Figure 6:
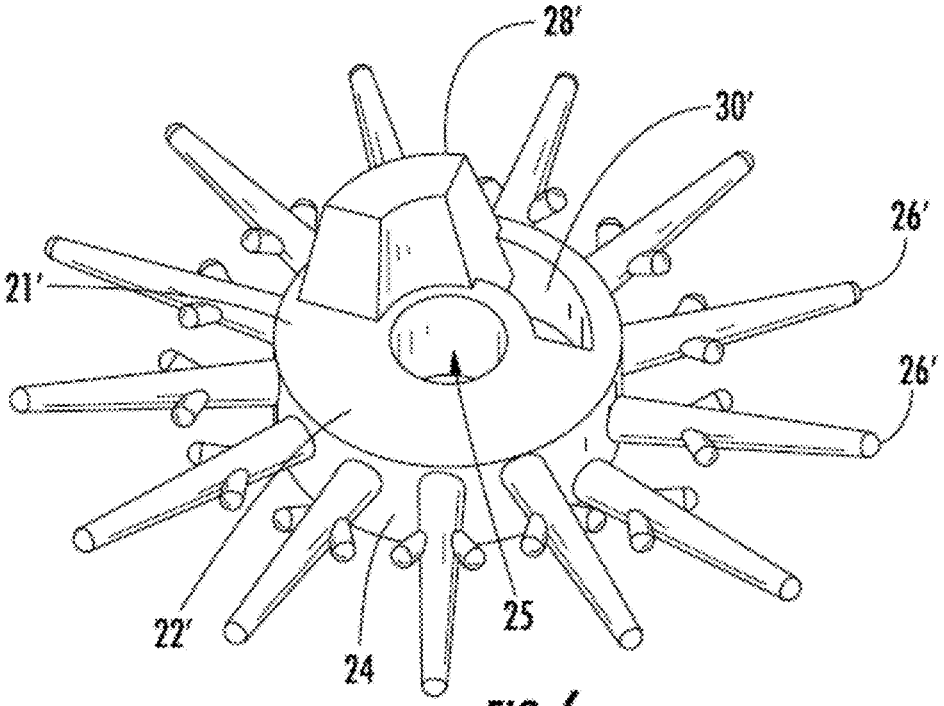
FIG. 6 is a top perspective view of the disc of FIG. 5.
Figure 7:
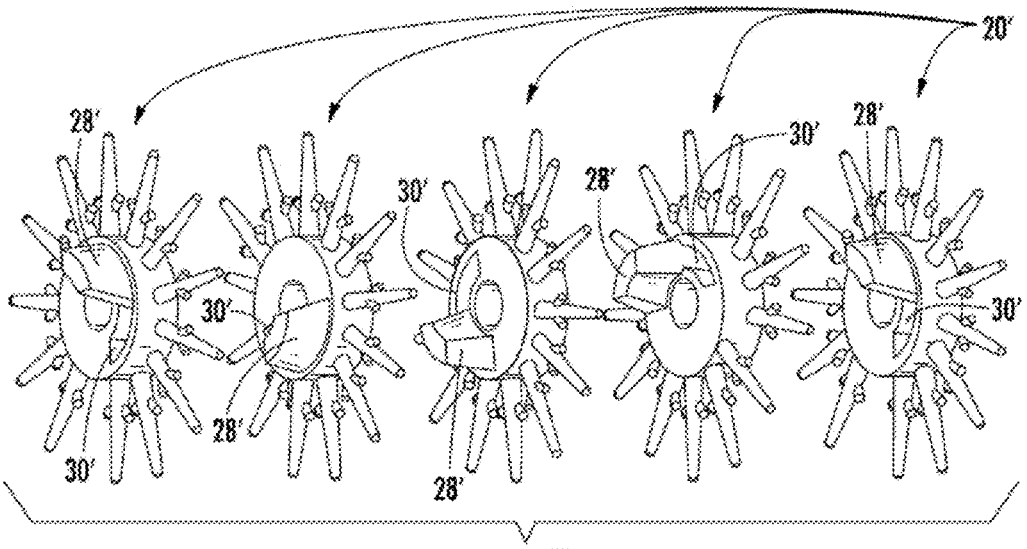
FIG. 7 is an exploded perspective view of a cosmetic applicator brush, without the central rod, utilizing discs of FIG. 5.

Referring to FIGS. 3 and 4, each disc has a disc body 22 extending between opposed faces 21 and 23 and a sidewall 24 between the faces 21, 23. Bristles 26 extend from the sidewall 24 in a desired configuration. Bristles 26 can be placed and extended radially from any positions in each disc. A number of the bristles 26 is greater than or equal to three. Bristles 26 may further comprise one or more branches with different sizes. Alternatively, bristles 26 may not comprise any branches. Bristles 26 may have different dimensions. In the illustrated embodiment, the bristles 26 extend in a spiral configuration about the body 22, but any desired configuration may be utilized. A through bore 25 extends through the body 22 such that each disc 20 may be positioned on the rod 12. Again, the through bore 25 does not have a keyed configuration.

To achieve the desired relationship between adjacent discs 20, each disc 20 has a projection 28 extending from the face 21 and an indentation 30 defined on the opposite face 23. The projection 28 and the indentation 30 are located with an angular offset relative to one another. In FIG. 3, the projection 28 has a radial axis at approximately 1 o'clock while in FIG. 4, the indentation 30 has a radial axis at approximately 5 o'clock. The angular offset defines the offset between the bristles 26 on adjacent discs 20. The angular offset can be anything from 0° to 360° and the offset may be consistent among all of the discs 20 or it may change amongst one or more of the discs to produce other desirable bristle configurations. The projections 28 and indentations 30 have complimentary configurations, for example, the illustrated trapezoidal shape, however, the invention is not limited to the illustrated shape. The complimentary shapes lock the discs 20 into each other in a designated position and maintain the desired angular offset from the previous disc and to the next discs in the stack.

Figure 8:
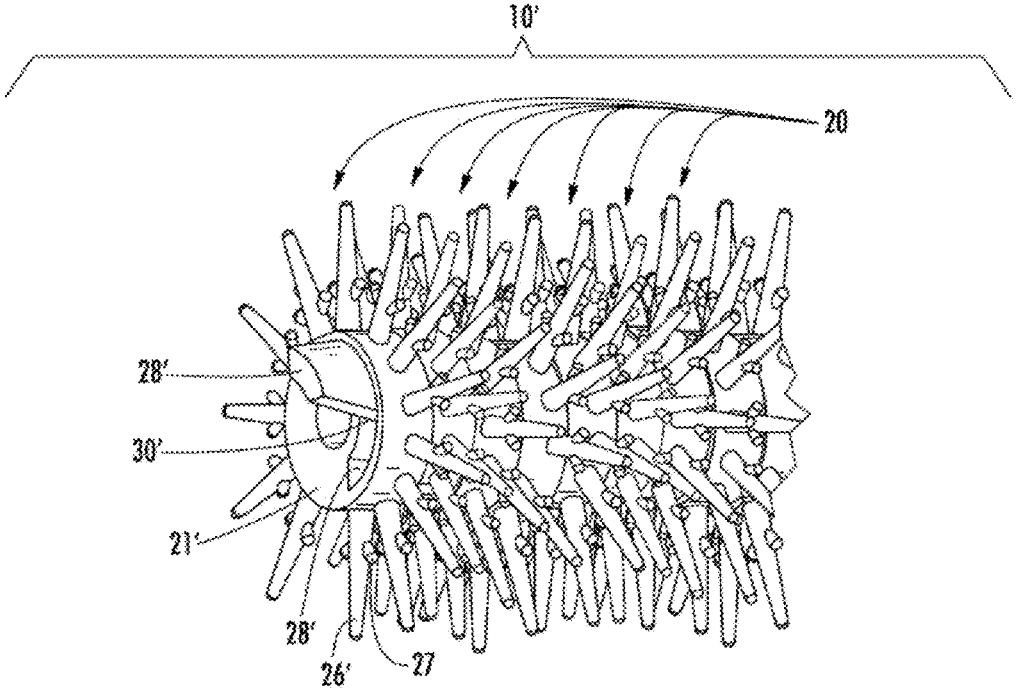
FIG. 8 is an assembled view of the cosmetic applicator brush of FIG. 7.
Figure 23:
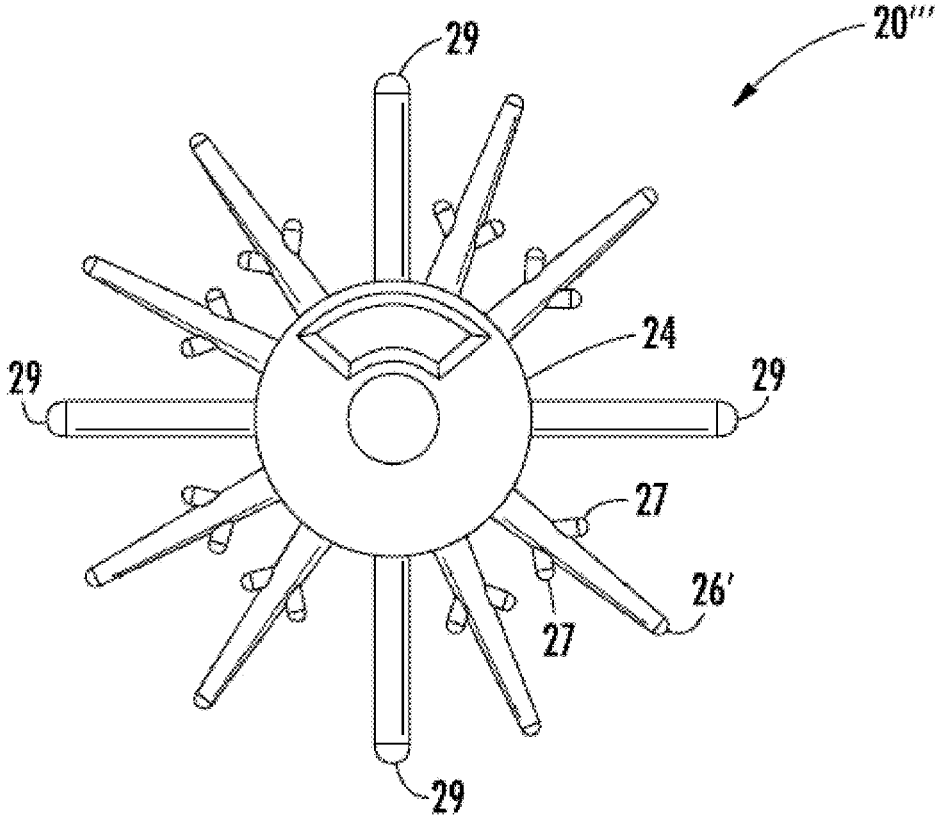
FIG. 23 is a plan view of an exemplary disc in accordance with another exemplary embodiment of the invention.
Figure 24:
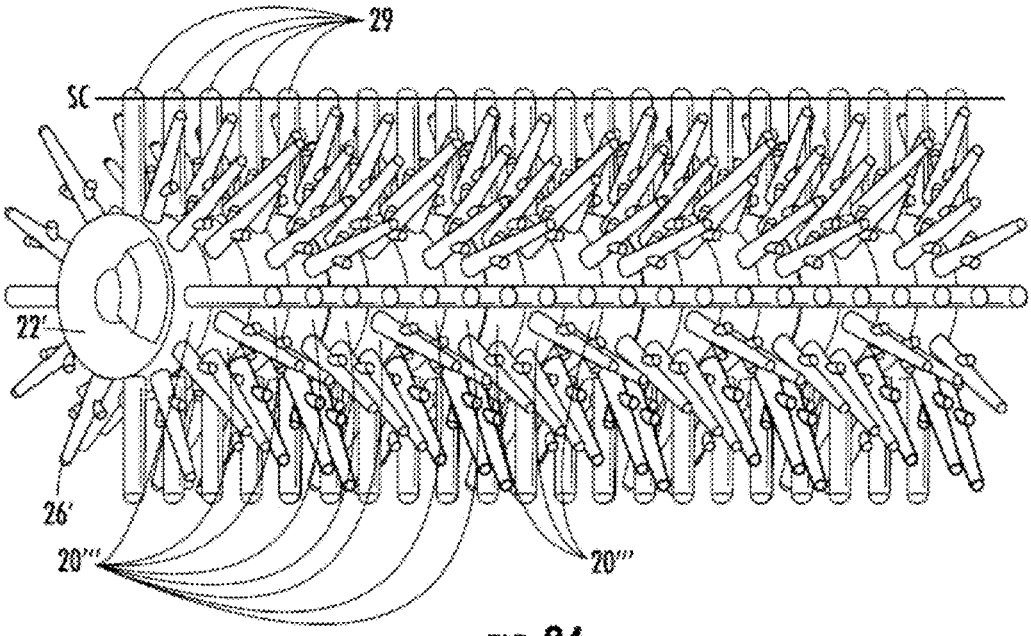
FIG. 24 is an assembled view of a cosmetic applicator incorporating the disc of FIG. 23.
Figure 25:
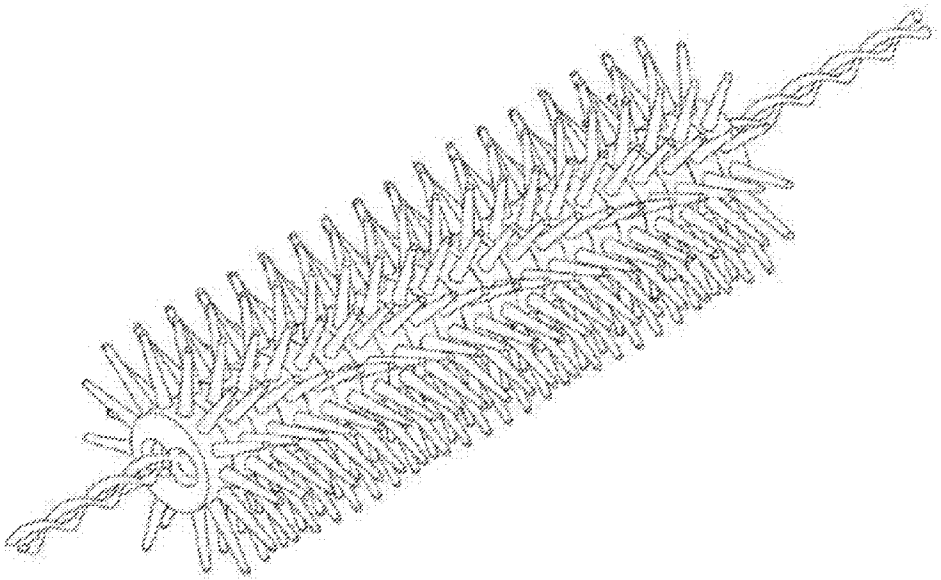
FIGS. 25(A)-(D) are assembled views of the cosmetic applicator brush of FIG. 14, where a plurality of stacked discs is interconnected to one another via a pair of wires.
Figure 25:
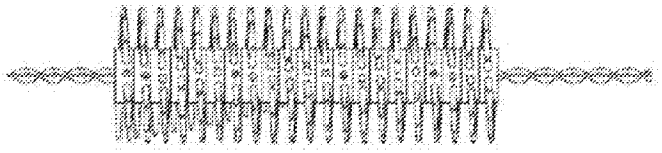
Figure 25:
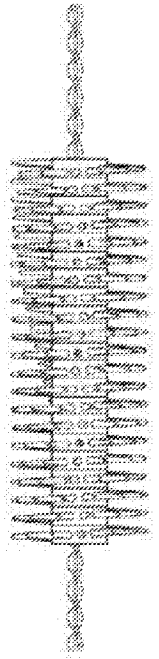
Figure 25:
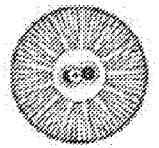
Figure 26:
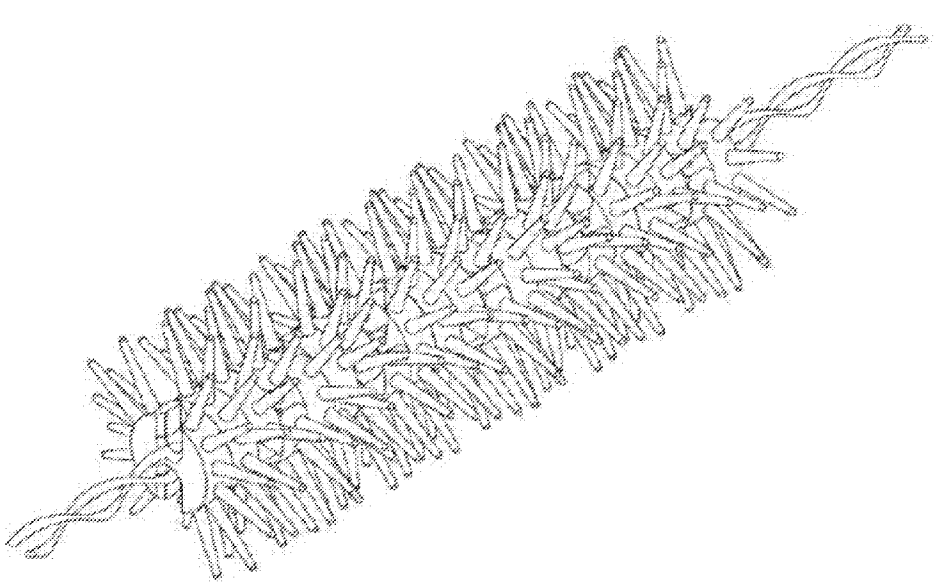
FIGS. 26(A)-(D) are assembled views of the cosmetic applicator brush of FIG. 17, where the passages through the discs extend to the outside surface of the disc body.
Figure 26:
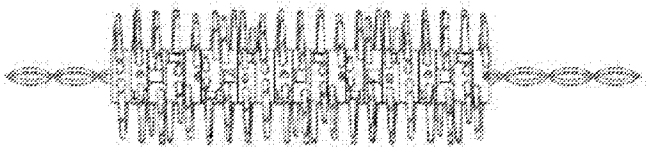
Figure 26:
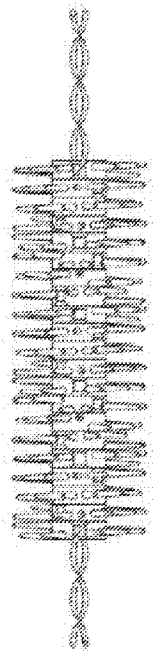
Figure 26:
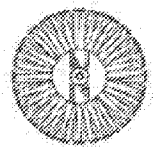
Figure 27A:
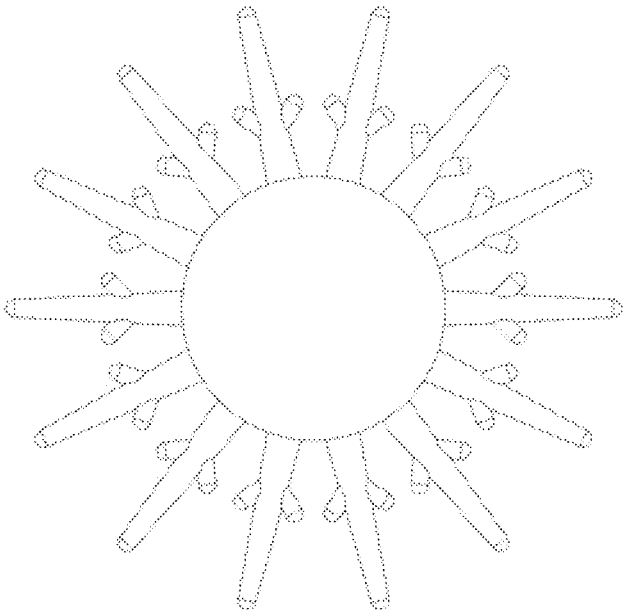
FIGS. 27(A)-(L) are top perspective views of exemplary discs of the applicator brush with different shapes and sizes.
Figure 27B:
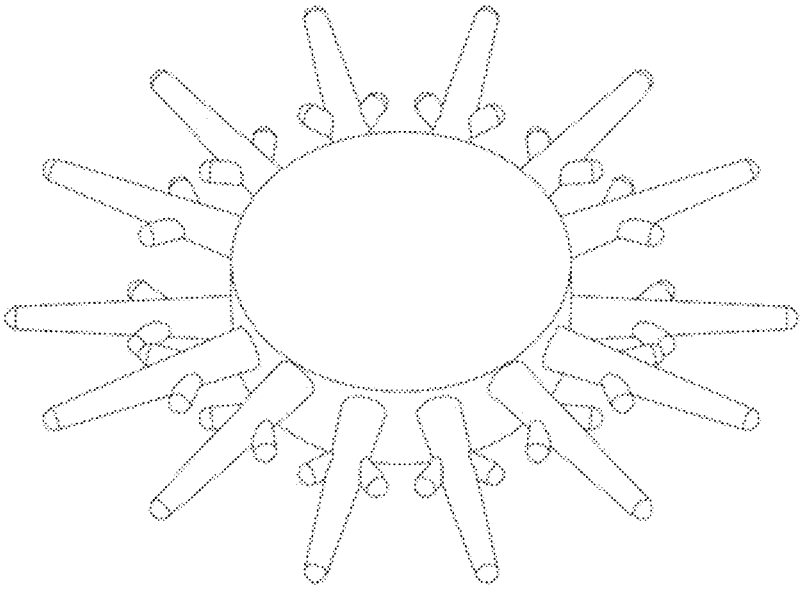
Figure 27C:
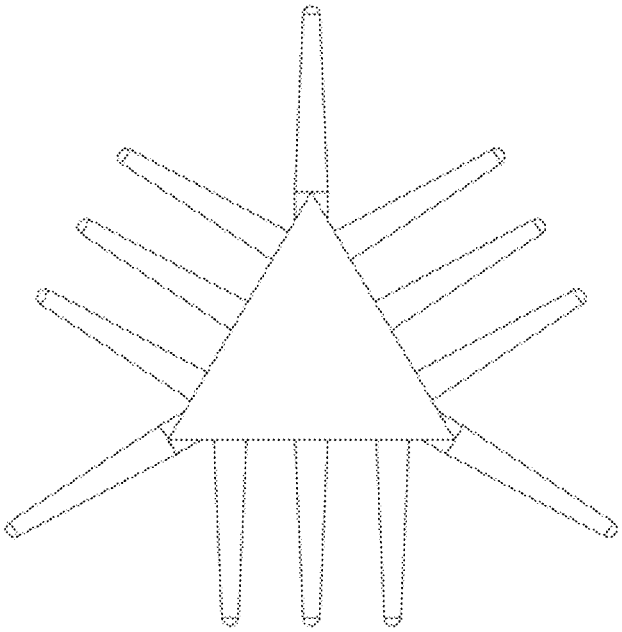
Figure 27D:
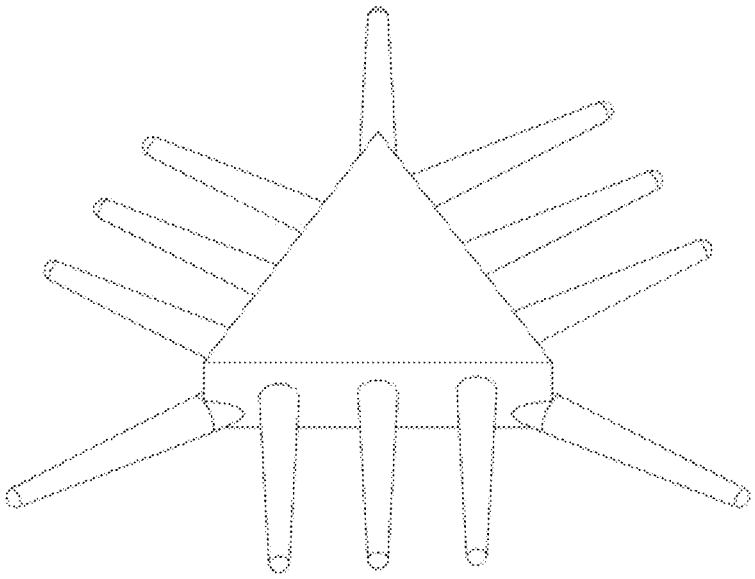
Figure 27E:
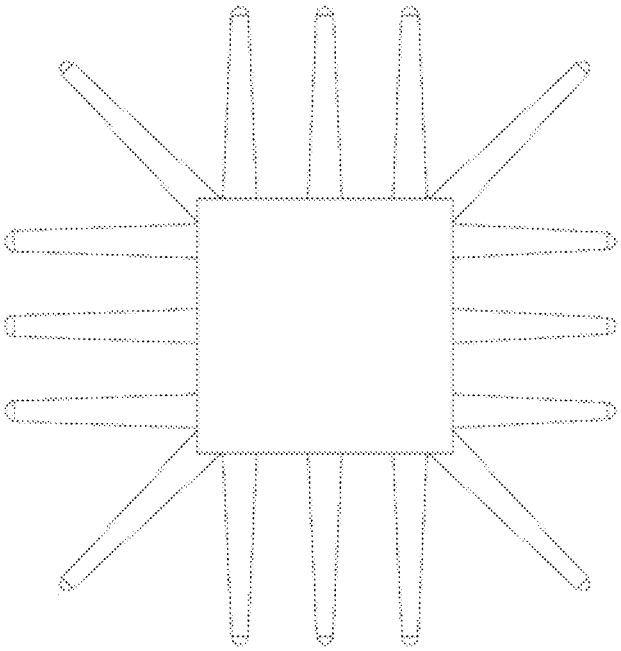
Figure 27F:
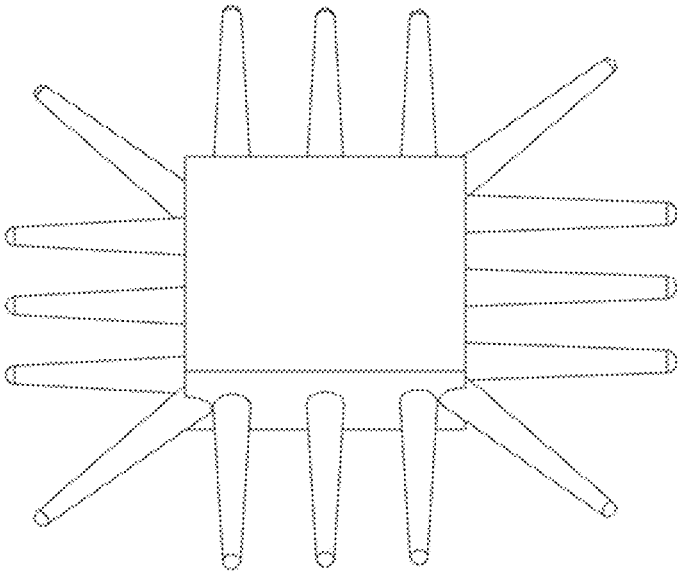
Figure 27G:
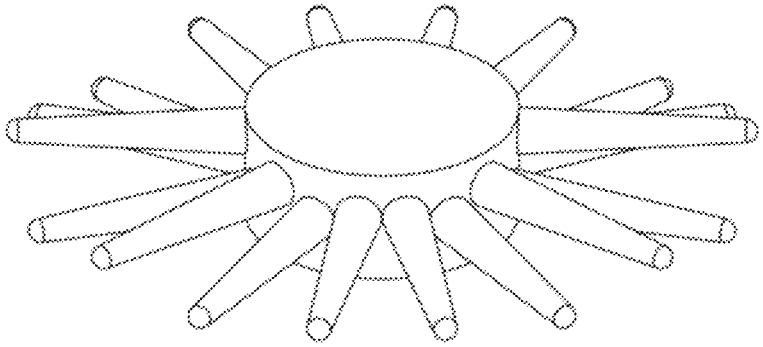
Figure 27H:
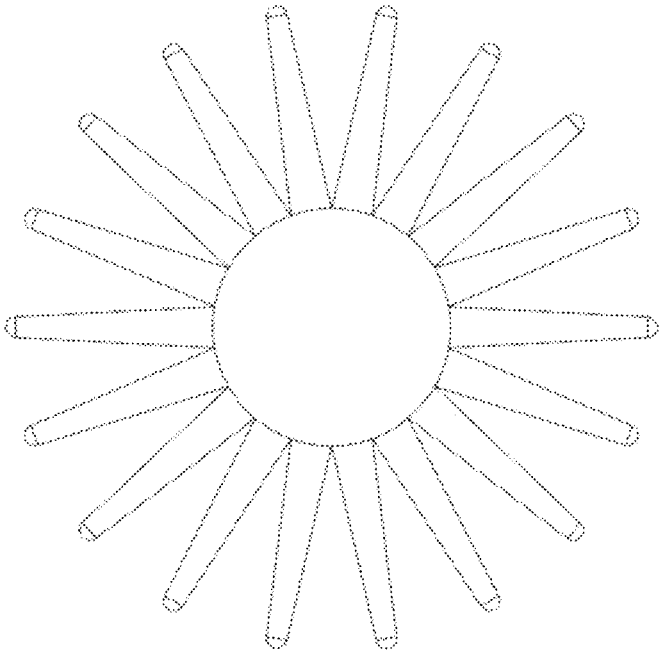
Figure 27I:
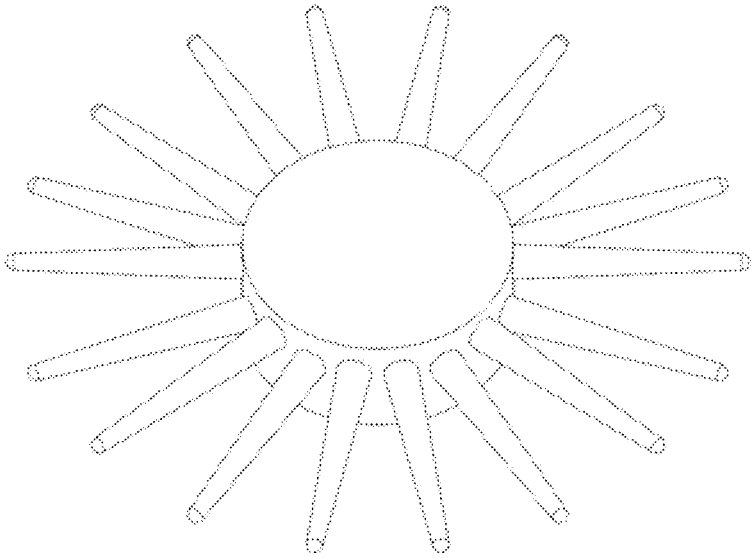
Figure 27J:
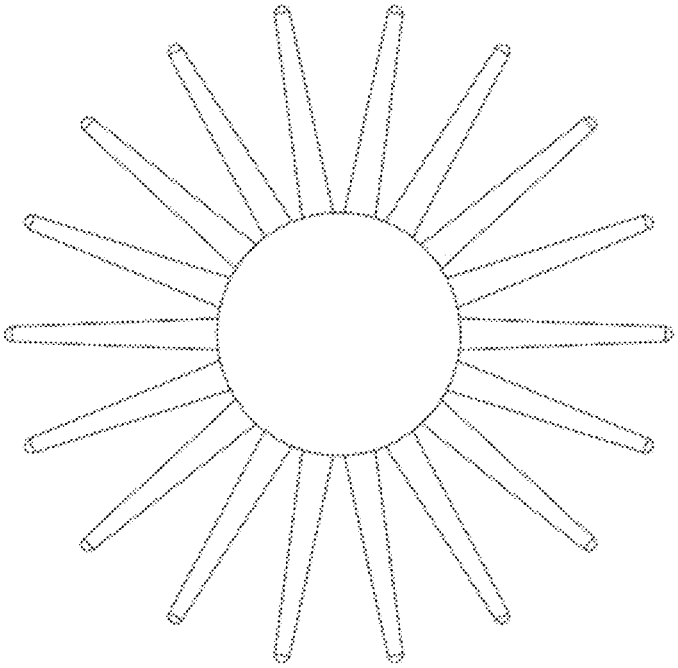
Figure 27K:
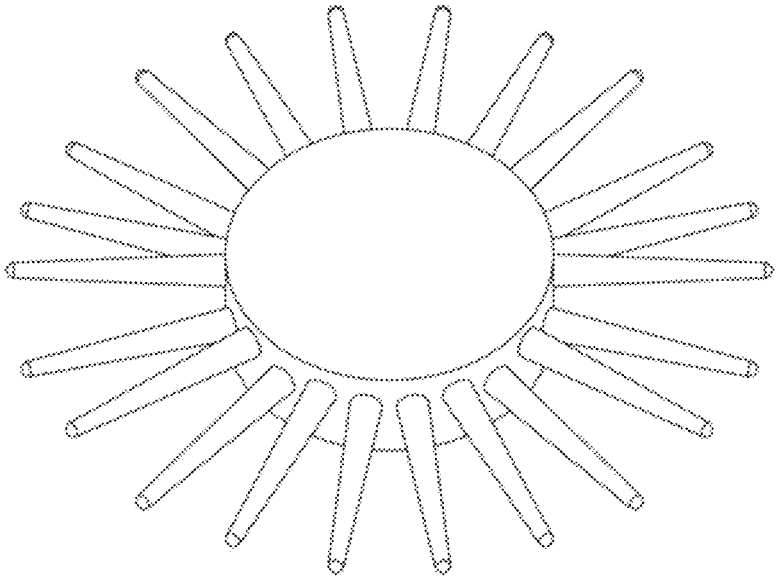
Figure 27L:
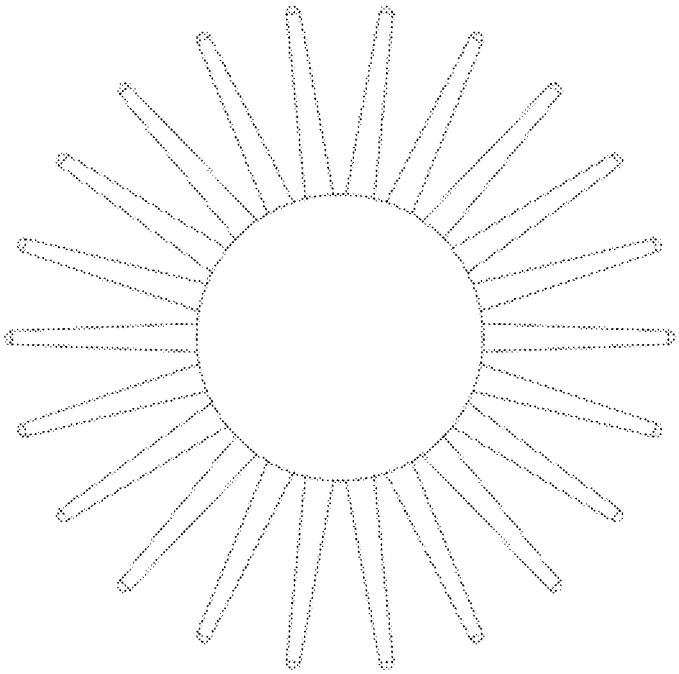
Figure 31:
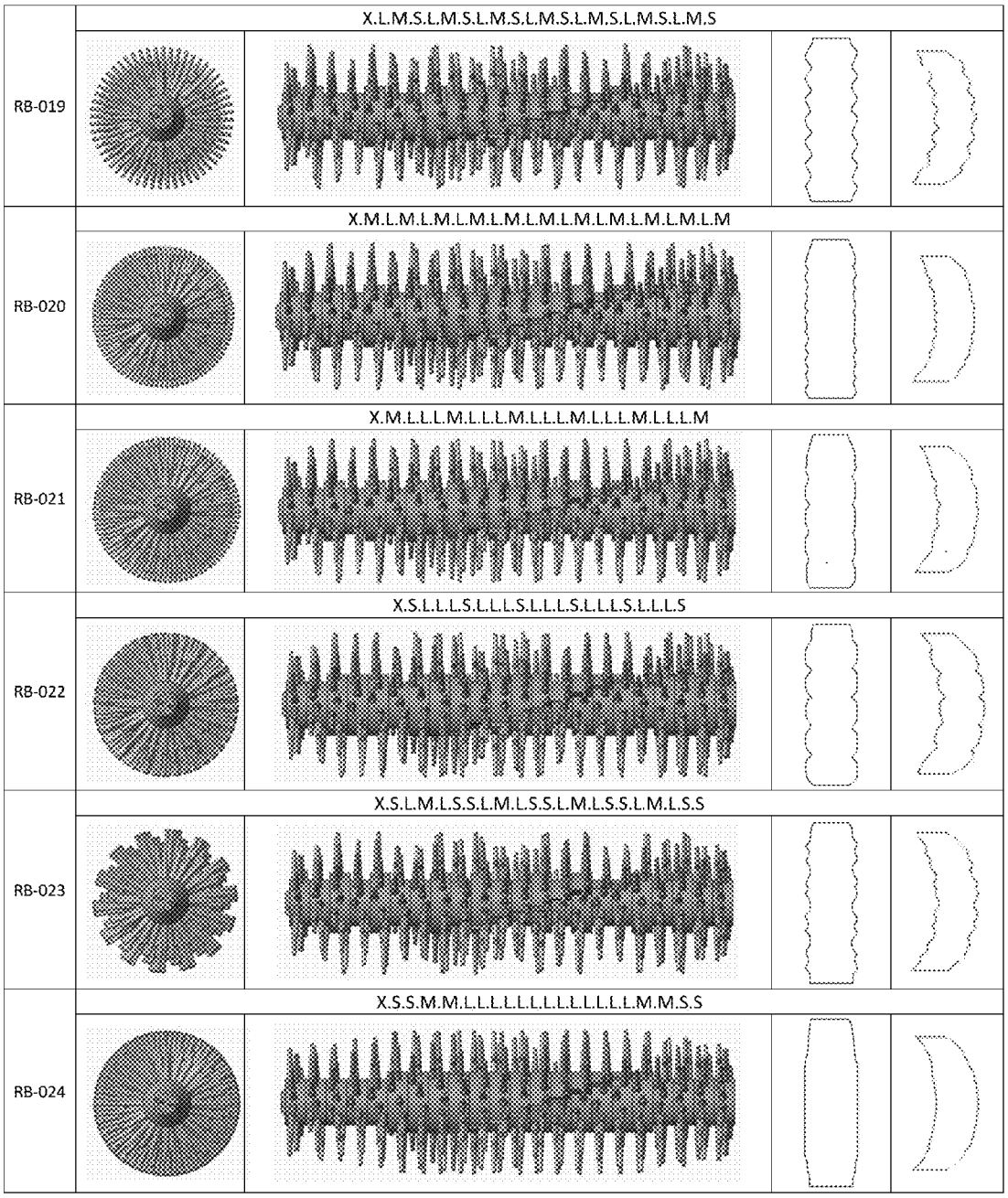
Figure 32:
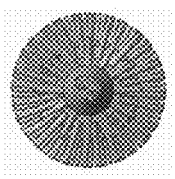
Figure 32:
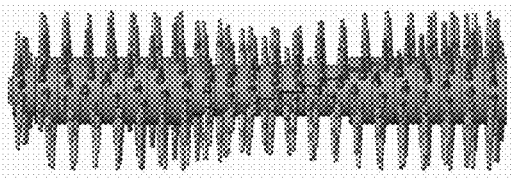
Figure 32:
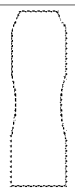
Figure 32:
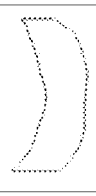
Figure 32:
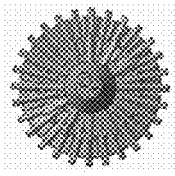
Figure 32:
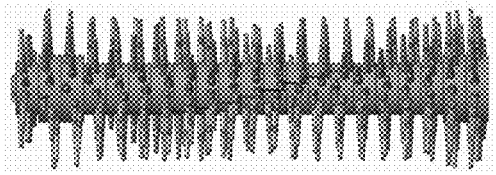
Figure 32:
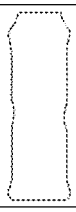
Figure 32:
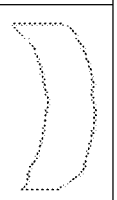
Figure 32:
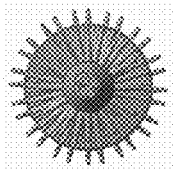
Figure 32:
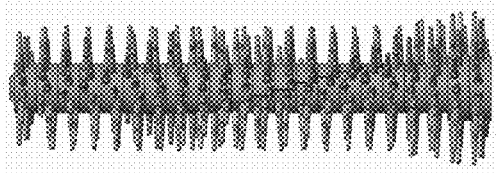
Figure 32:
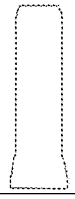
Figure 32:
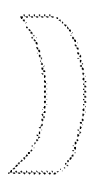
Figure 32:
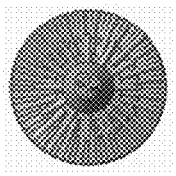
Figure 32:
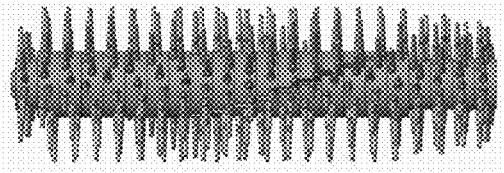
Figure 32:
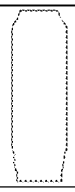
Figure 32:
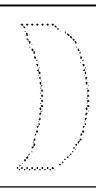
Figure 32:
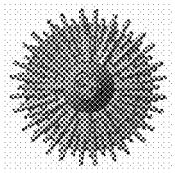
Figure 32:
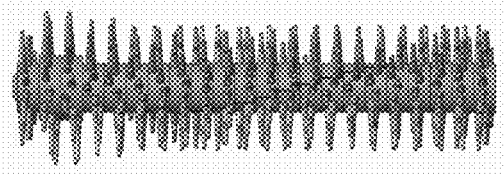
Figure 32:
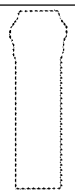
Figure 32:
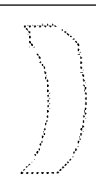
Figure 32:
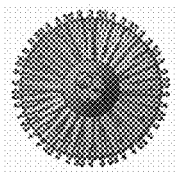
Figure 32:
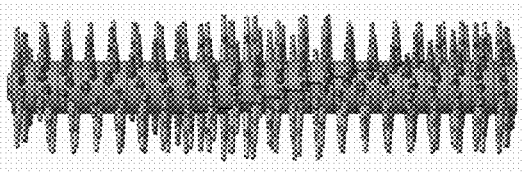
Figure 32:
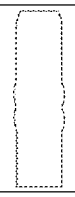
Figure 32:
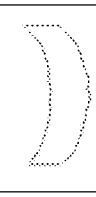
Figure 37:
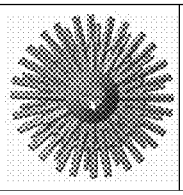
Figure 37:
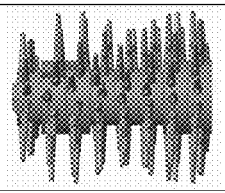
Figure 37:
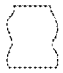
Figure 37:
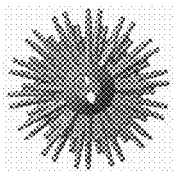
Figure 37:
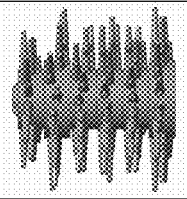
Figure 37:
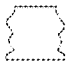
Figure 37:
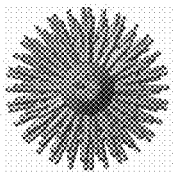
Figure 37:
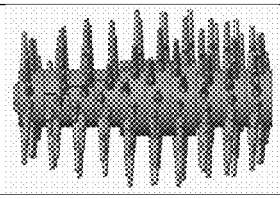
Figure 37:
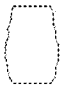
Figure 37:
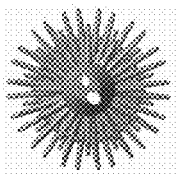
Figure 37:
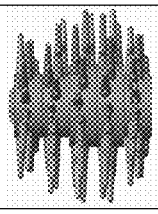
Figure 37:
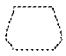
Figure 37:
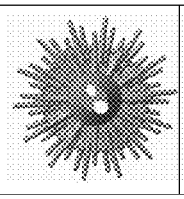
Figure 37:
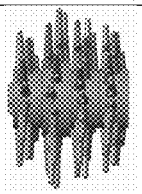
Figure 37:
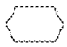
Figure 37:
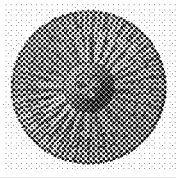
Figure 37:
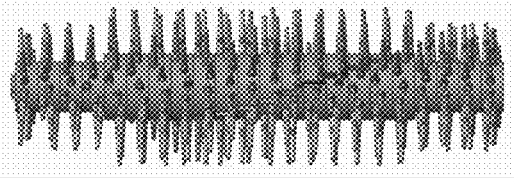
Figure 37:
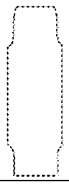
Figure 37:
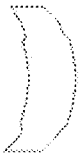
Figure 61:
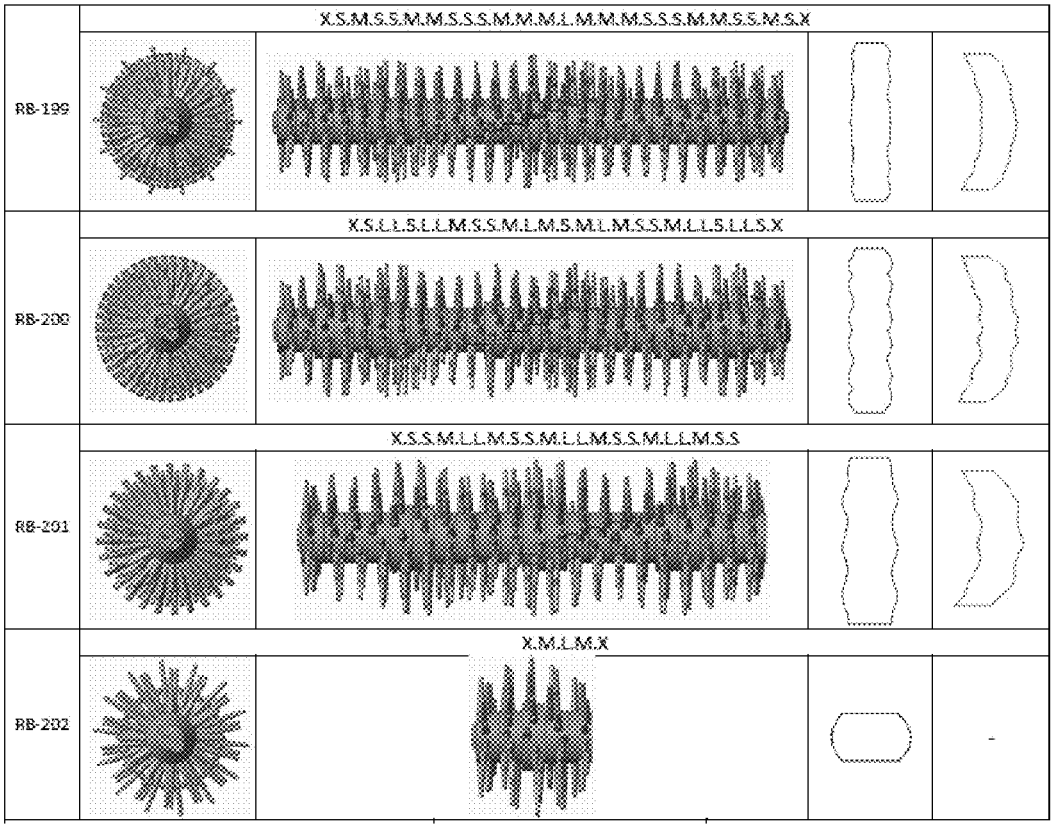
Figure 62:
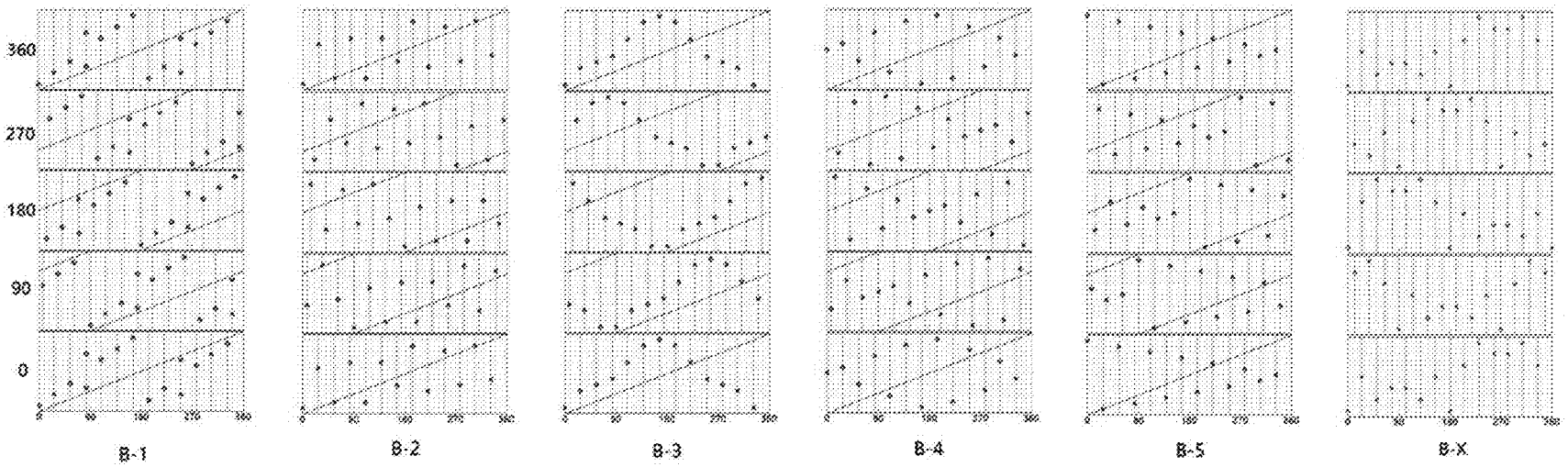
FIG. 62 is a developed view of the applicator brush showing different alignments for the bristles of the applicator brush.
Figure 63:
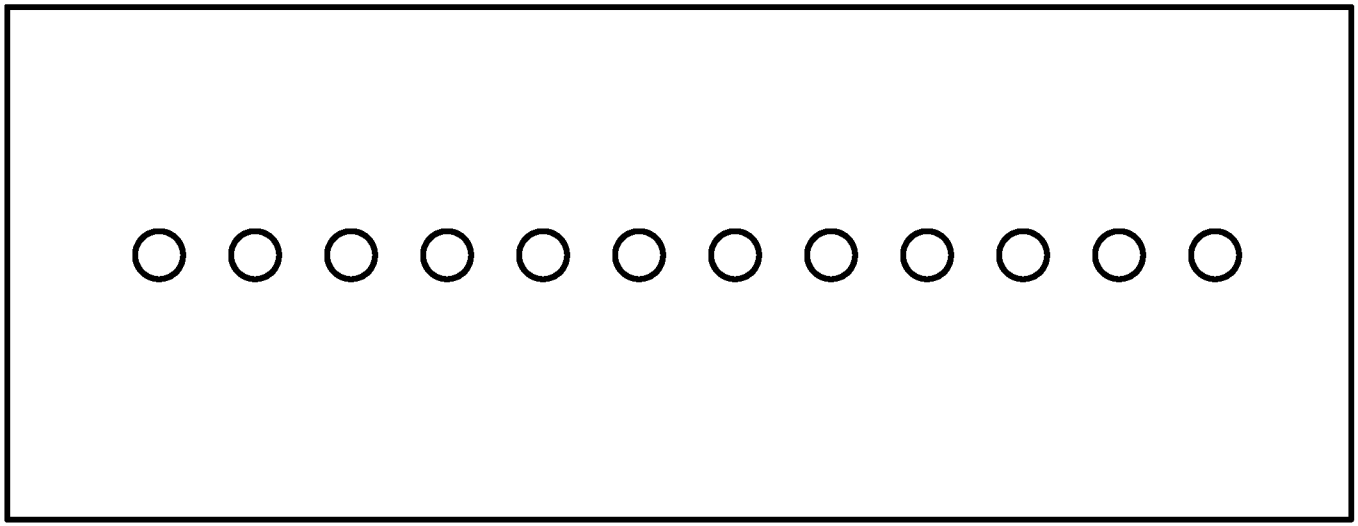
FIGS. 63-64 are examples of the bristles of the applicator brush with different alignments.
Figure 64:
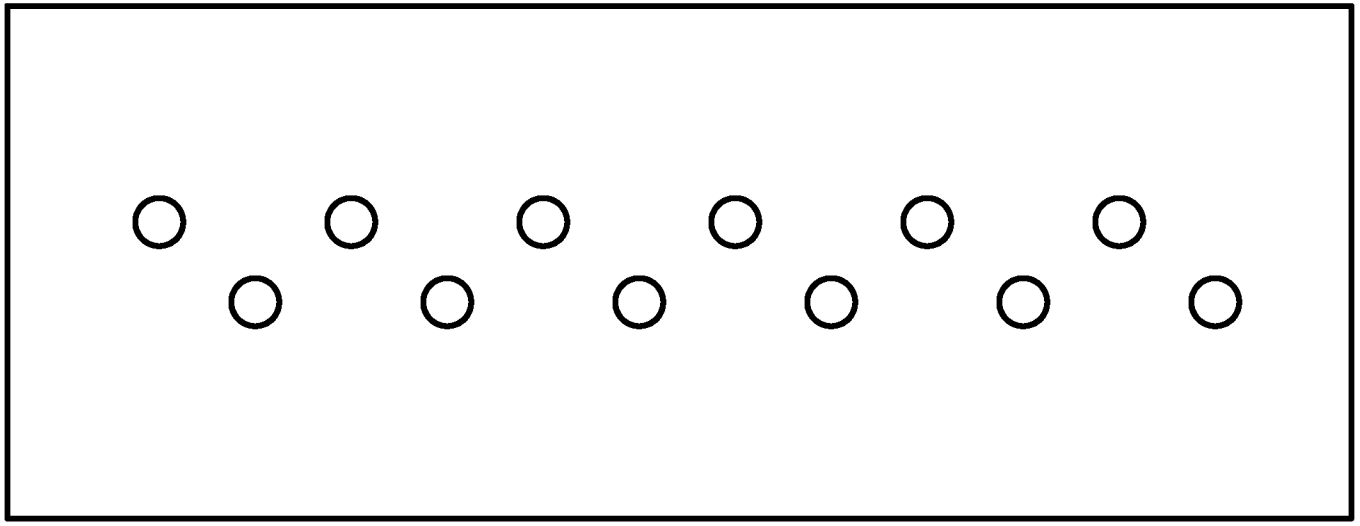

Referring to FIGS. 5-8, another cosmetic applicator brush 10' in accordance with an exemplary embodiment of the invention will be described. The applicator brush 10' is similar to the previous embodiment and includes a rod (not shown) extending through bores 25 of stacked discs 20'. In the present embodiment, the indentations 30' extend completely through the disc body 22' such that they open into face 21. The projections 28' each have a height equal to the height of the body 22' such that a top surface of the projection 28' is flush with the face 21' of the adjacent disc 22' when assembled, as shown in FIG. 8. It is further contemplated that one or more projections 28' may have a height larger than the height of the body 22' such that the projection 28' would extend into the indentation of a second adjacent disc. Again, the projections 28' and the indentations 30' are at an angular offset with respect to one another. It is further noted that the bristles 26' have a different configuration with secondary bristles 27 extending from the main bristles 26'. The invention is not limited to the illustrated bristles and various combinations may be utilized. As one example, the combination of bristles may include, but is not limited to, variations of size, shape, color, material, nomenclature or method of fabrication (mono-injection, bi-injection). For example, a comb may be utilized in placement of a bristle to straighten, de-clump, and possibly extend lashes during application. Referring to FIGS. 23-24 for this example, FIG. 23 shows multiple combs 29 protruding from the sidewall 24 of the body 22' of the disc 20''' replacing the respective bristles 26'. In all other respects, the disc 20''' has the configuration of the discs 20' of FIGS. 5-8. When assembled, the combs 29 will form a straight path SC as depicted in FIG. 24.

Figure 9:
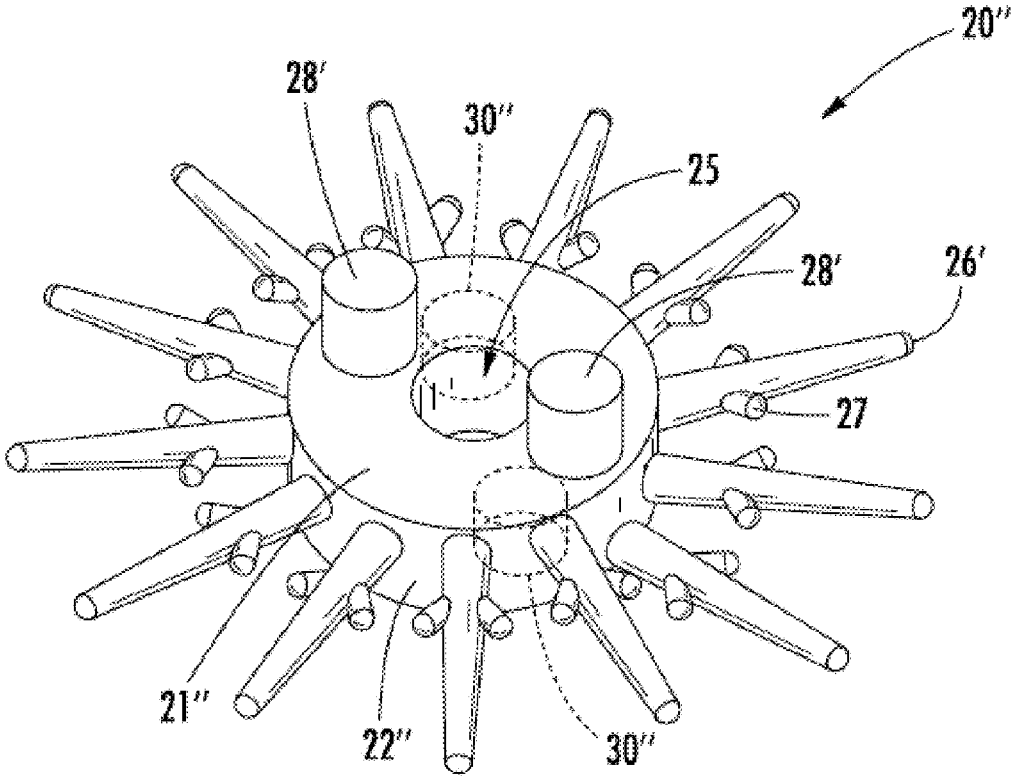
FIG. 9 is a top perspective view of an exemplary disc in accordance with another embodiment of the invention.
Figure 10:
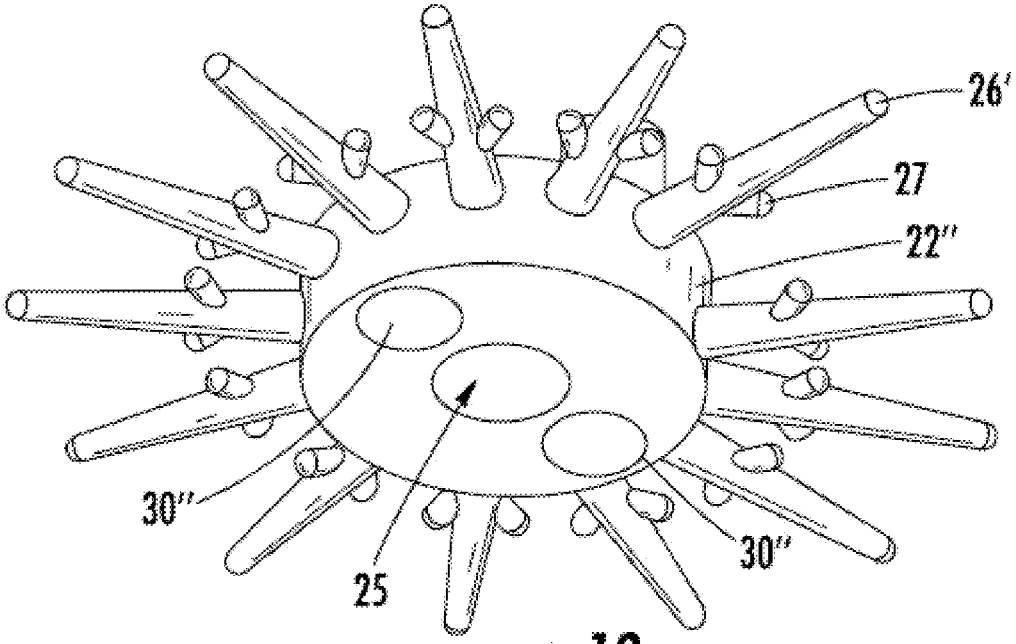
FIG. 10 is a bottom perspective view of the disc of FIG. 9.

Referring to FIGS. 9 and 10, an exemplary disc 20" in accordance with another embodiment of the invention will be described. In the present embodiment, a pair of projections 28" extend from face 21" of body 22" while a corresponding pair of indentations 30" are defined in the opposite face 23". In the present embodiment, the projections 28" and indentations 30" have complementary circular configurations. Again, the projections 28' and the indentations 30' are at an angular offset with respect to one another. In all other respects, the discs 20" may be stacked on a rod (not shown) to achieve a brush with a desired configuration.

It is further recognized that in any of the illustrated embodiments, the applicator brush may include other components other than the illustrated bristle discs. For example, a rod, comb or disc with a different bristle arrangement can be attached in the middle or end to produce a different desired shape or configuration. Additionally, while the discs are shown stacked along the rod 12, it is possible to attach the individual discs with other mechanical or chemical means, such as glue, laser or ultrasonic welding and any other similarly employed techniques while optionally employing the axial rod.

Figure 11:
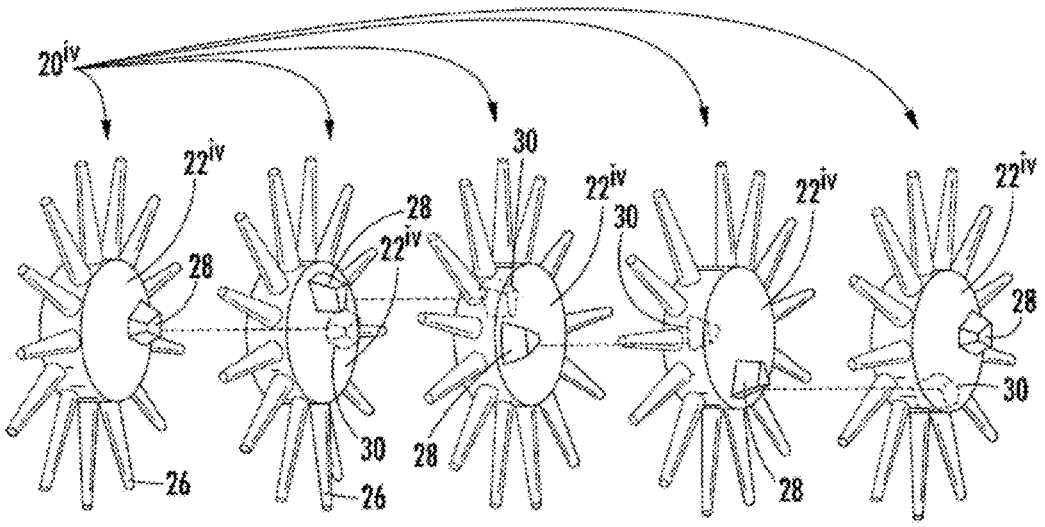
FIG. 11 is an exploded perspective view of a cosmetic applicator brush utilizing discs in accordance with another embodiment of the invention.
Figure 12:
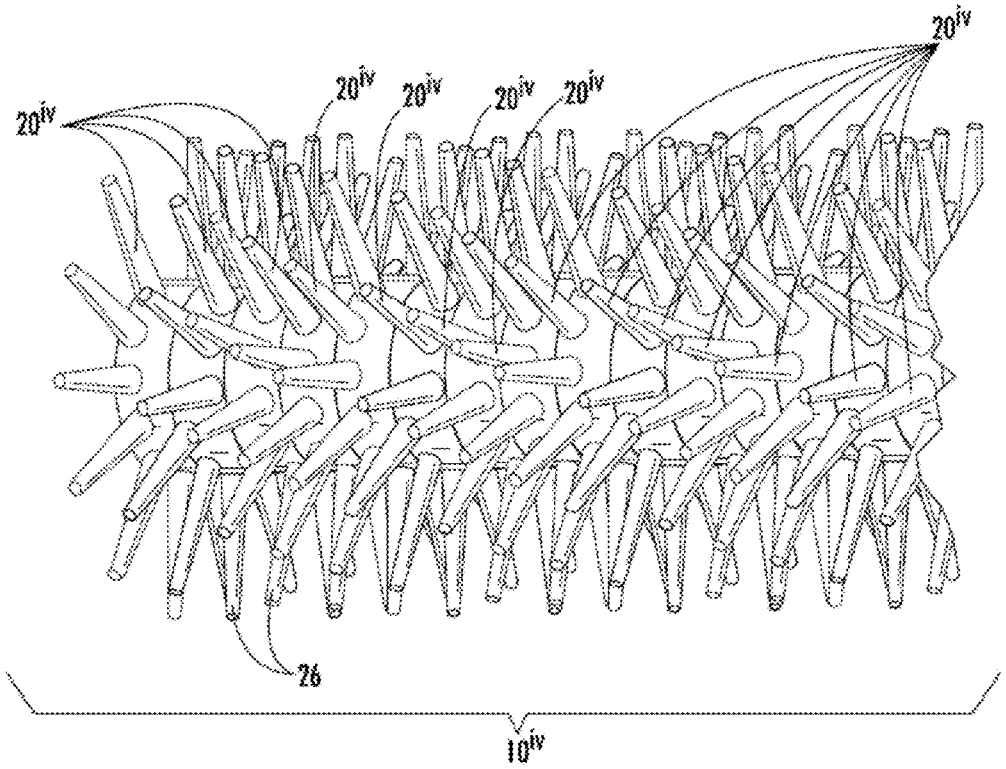
FIG. 12 is an assembled view of the cosmetic applicator brush of FIG. 11.

Referring to FIGS. 11 and 12, a cosmetic applicator brush $\mathbf{10}^{iv}$ in accordance with another embodiment of the invention will be described. The present embodiment is similar to the first embodiment accept that the body $\mathbf{22}^{iv}$ of each disc $\mathbf{20}^{iv}$ does not include a through bore. Instead, to connect the discs $\mathbf{20}^{iv}$, the projections 28 and indentations 30 fit tightly so that the discs $\mathbf{20}^{iv}$ are holding onto each other to form a brush without a rod. It is further possible to attach the individual discs with other mechanical or chemical means, such as glue, laser or ultrasonic welding and any other similarly employed techniques while optionally employing the axial rod.

Figure 13:
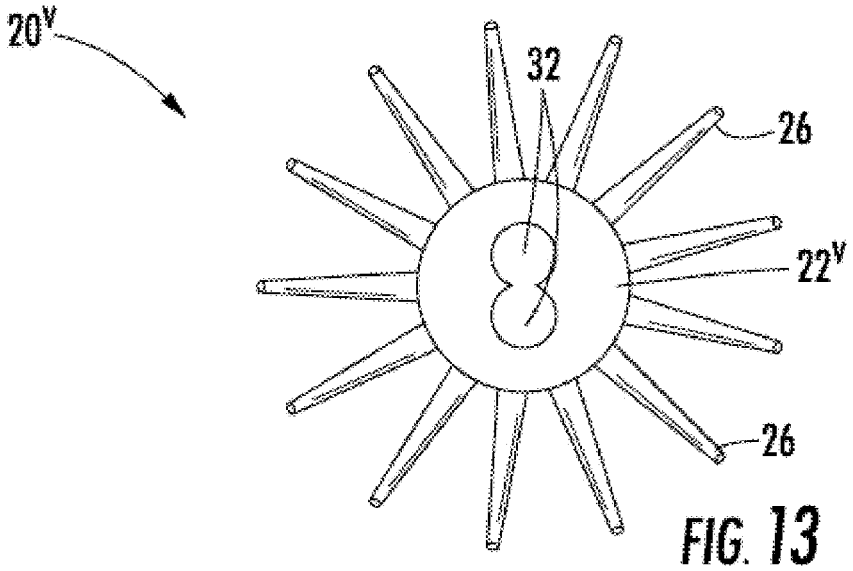
FIG. 13 is a top perspective view of an exemplary disc in accordance with another embodiment of the invention.
Figure 14:
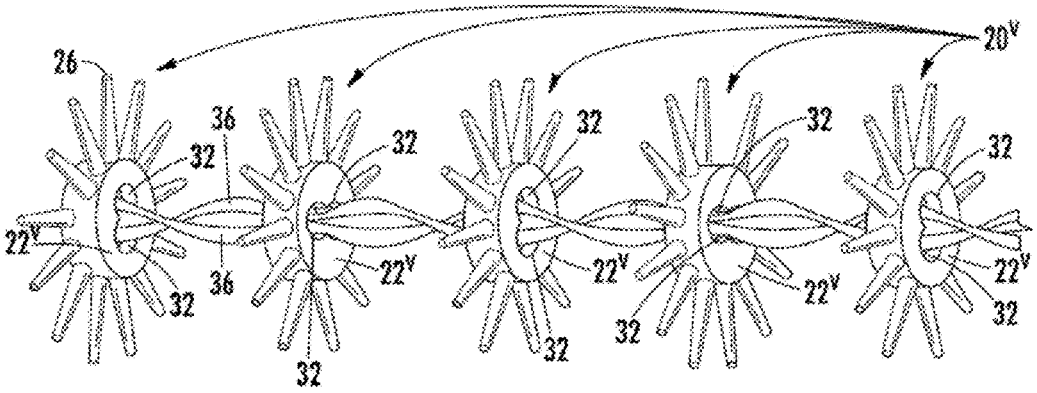
FIG. 14 is an exploded perspective view of a cosmetic applicator brush utilizing discs of FIG. 13.
Figure 15:
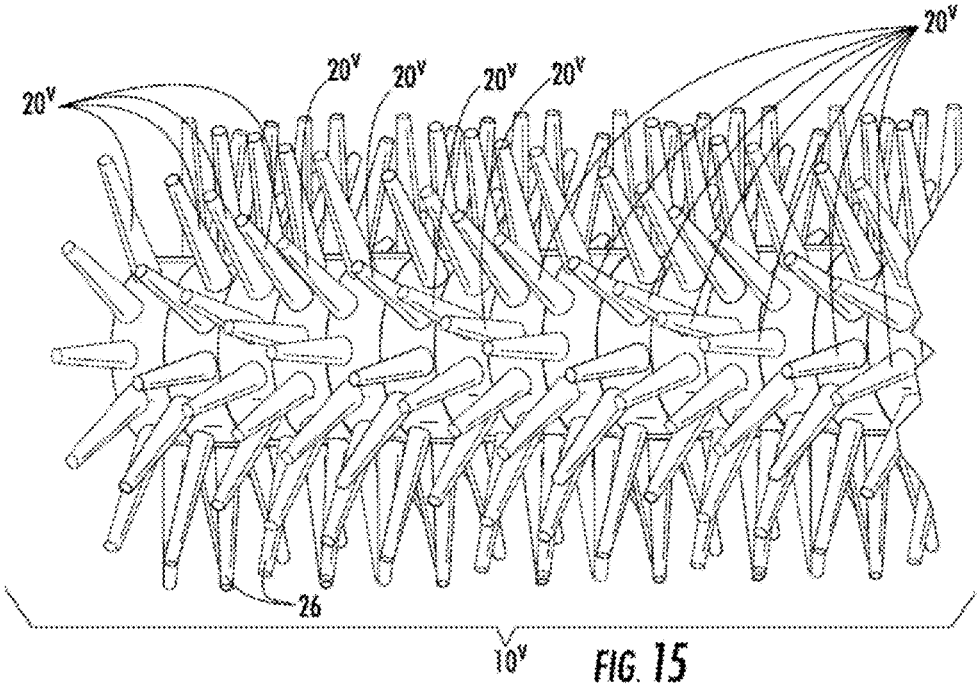
FIG. 15 is an assembled view of the cosmetic applicator brush of FIG. 14.

Referring to FIGS. 13-15, a cosmetic applicator brush $\mathbf{10}^{v}$ in accordance with another embodiment of the invention will be described. The present embodiment includes a plurality of stacked discs $\mathbf{20}^{v}$ which are interconnected to one another via a pair of wires 36, which may be separate wires or formed from a single wire folded and returned. Additionally, while wire is described herein, string or similar structures may be utilized. The body $\mathbf{22}^{v}$ of each disc $\mathbf{20}^{v}$ includes a pair of wire passages 32. As illustrated in FIG. 14, each wire 36 is passed through the respective wire passage 32 of successive discs $\mathbf{20}^{v}$. Once the pair of wires 36 is passed through the stacked discs $\mathbf{20}^{v}$, all the discs $\mathbf{20}^{v}$ are linked together and then they can be twisted to form a desired shape where each disc $\mathbf{20}^{v}$ has a finite angular offset compared to the disc $\mathbf{20}^{v}$ before and after. The number of twist is not limited to one. For example, it is preferred that the number of twist is between 2 and 60. The shape of the passages 32 has no relation with how the angular offset is determined, instead the angular offset is determined by the twist of the wire 36 going through the passages 32 and therefore the passages 32 can be in any shape as desired. According to the angle, design, and material of the disc, appropriate material can be chosen for the wire, string or the like, for example, a deformable elastic material, which will enable changes in angular offset on demand. For example, the deformable elastic material includes materials made of stainless steel or any material.

Figure 16:
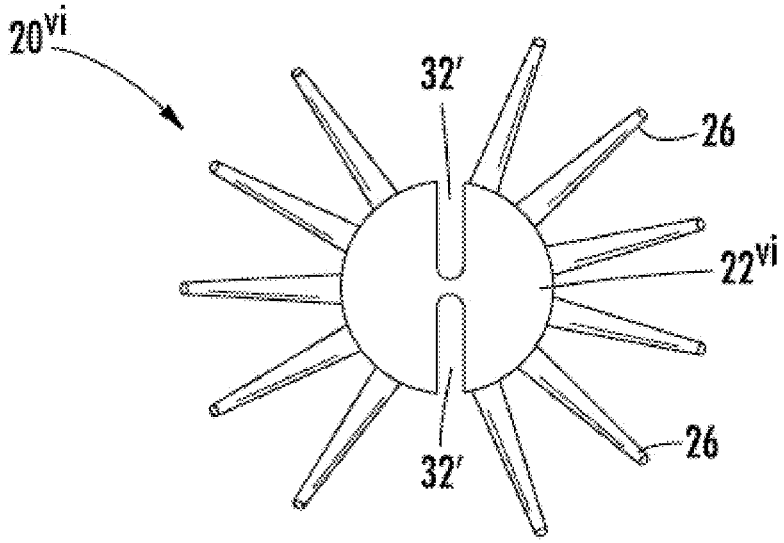
FIG. 16 is a top perspective view of an exemplary disc in accordance with another embodiment of the invention.
Figure 17:
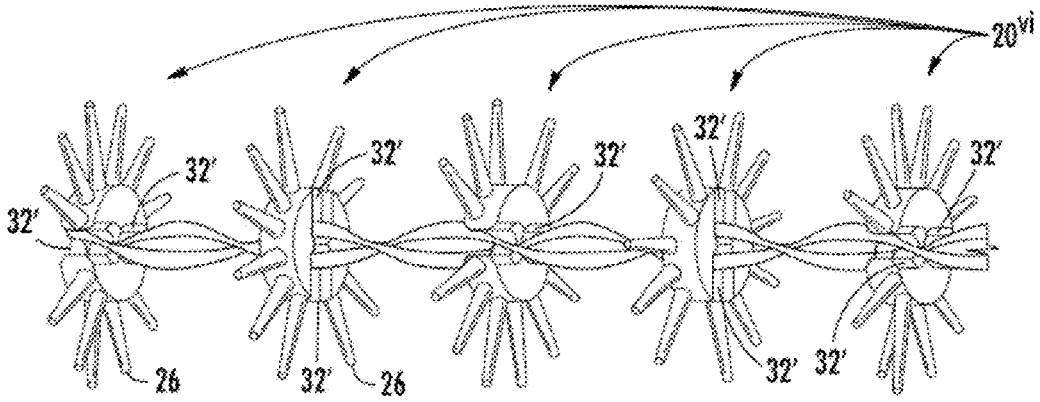
FIG. 17 is an exploded perspective view of a cosmetic applicator brush utilizing discs of FIG. 16.
Figure 18:
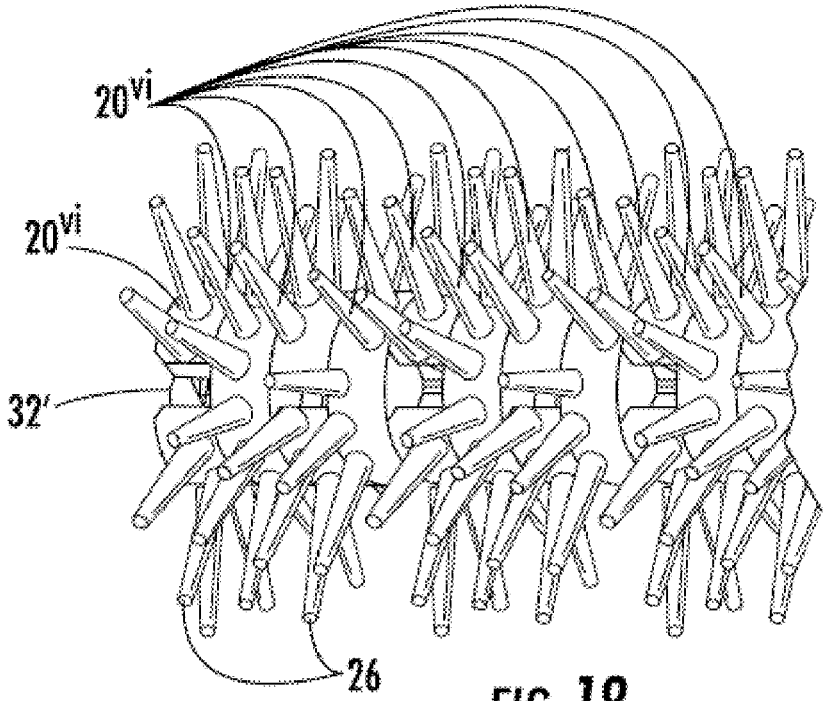
FIG. 18 is an assembled view of the cosmetic applicator brush of FIG. 17.

Referring to FIGS. 16-18, a cosmetic applicator brush $\mathbf{10}^{vi}$ in accordance with another embodiment of the invention will be described. The present embodiment is substantially the same as in the previous embodiment except that the passages $\mathbf{32}^{vi}$ through the discs $\mathbf{20}^{vi}$ extend to the outside surface of the disc body $\mathbf{22}^{vi}$. Such a configuration allows the wire 36 to enter before or after discs $\mathbf{20}^{vi}$ are in an assembled position. In all other aspects, the brush $\mathbf{10}^{vi}$ is the same as in the previous embodiment. It is further contemplated that one or more discs may have a closed passage 32 and an open passage 32'. The closed passage 32 serves as an anchor to hold the discs together while the open passage 32' can be used to determine angular offset between discs by having a shaped insert to guide each individual disc in formation.

Figure 19:
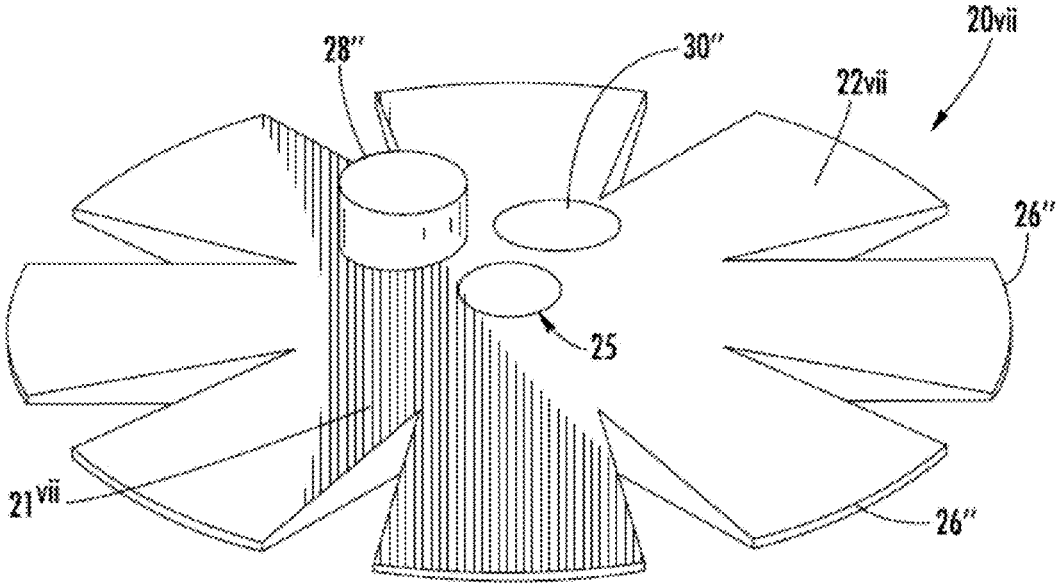
FIG. 19 is a top perspective view of an exemplary disc in accordance with another embodiment of the invention.
Figure 20:
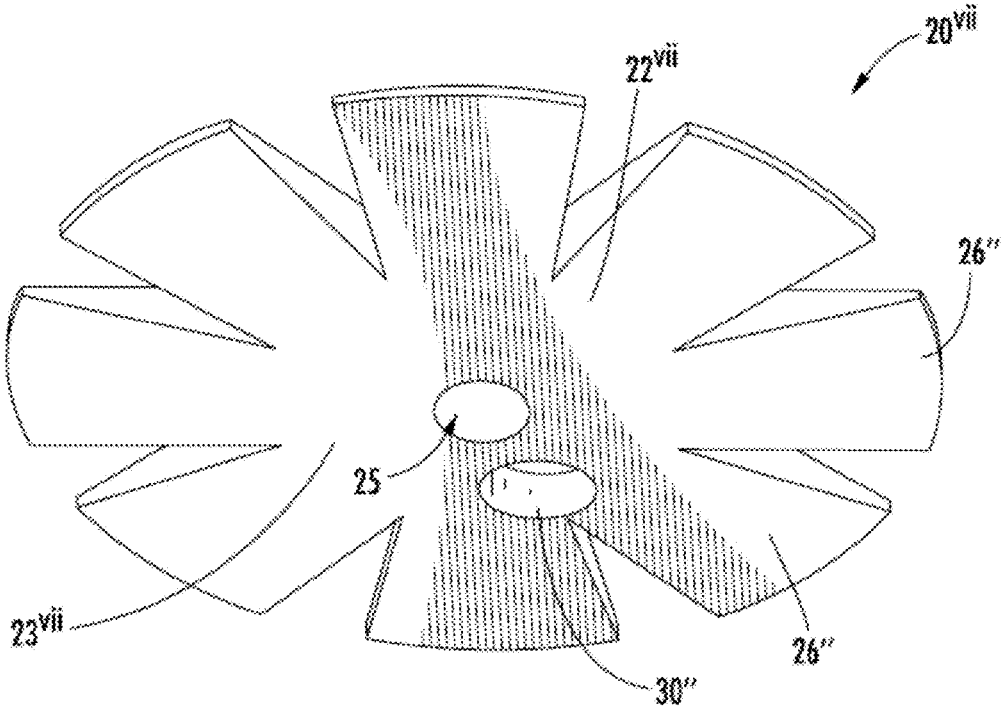
FIG. 20 is a bottom perspective view of the disc of FIG. 19.

FIGS. 19 and 20 illustrate an exemplary disc $\mathbf{20}^{vii}$ in accordance with another embodiment of the invention. In the present embodiment, a circular projection 28" extends from face $\mathbf{21}^{vii}$ of body $\mathbf{22}^{vii}$ while a corresponding indentation 30" is defined in the opposite face $\mathbf{23}^{vii}$. Again, the projections 28' and the indentations 30' are at an angular offset with respect to one another. In the present embodiment, the bristles 26" are formed by cutting shapes out of disc body $22^{vii}$. Rectangular bristles 26" are illustrated, but any desired shapes may be cut into the disc body $22^{vii}$ to form bristles 26" of any desired shape. It is understood that the term bristle as used herein includes any shape or structure extending radially outward to pick up the cosmetic and is not limited to the specific shapes or structures illustrated herein. The bristles may be of the same material as the disc body or of a different material and may be formed through any desired techniques including molding, double-shot molding, cutting, forming or like.

Figure 21:
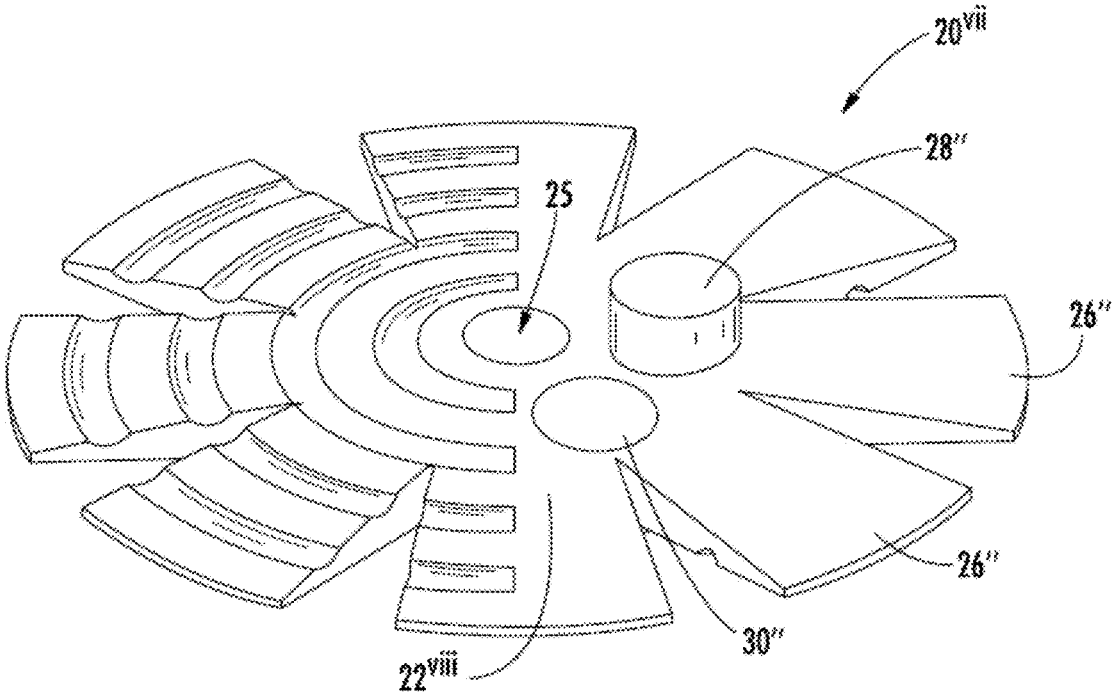
FIG. 21 is a top perspective view of an exemplary disc in accordance with another embodiment of the invention.
Figure 22:
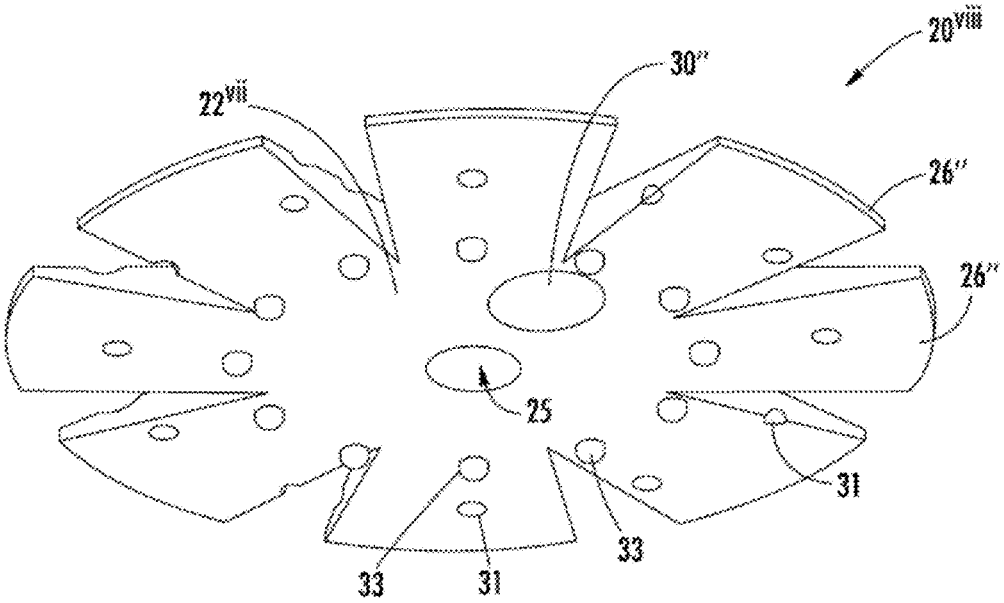
FIG. 22 is a bottom perspective view of the disc of FIG. 21.

Additionally, in the embodiment illustrated in FIGS. 19 and 20, the disc body $22^{viii}$ is thicker toward the center of the disc and thinner toward outer edge of the disc. Variations of the disc body thickness can be altered to produce various desired effects. For example, the disc body $22^{viii}$ can be thicker along the edge compared to the center in order to retain more mascara formula between the bristles 26". FIGS. 21 and 22 illustrate another embodiment of the disc $20^{viii}$ wherein the disc body $22^{viii}$ has a thickness which decreases and increases in pattern from the center toward the edge to create 'wavy' appearance or any other pattern if desired. Additionally, a variety of shapes and formation of features, for example, bumps 33 and recesses 31, may be added on the surface to enhance performance if so desired. In all other respects, the discs $20^{vii}$ and $20^{viii}$ may be stacked on a rod (not shown) to achieve a brush with a desired configuration. FIGS. 25(A)-(D) are assembled views of the cosmetic applicator brush of FIG. 14, where a plurality of stacked discs is interconnected to one another via a pair of wires. FIGS. 26(A)-(D) are assembled views of the cosmetic applicator brush of FIG. 17, where the passages through the discs extend to the outside surface of the disc body.

It is noted that while the shape of the disc in each example is circular, the invention is not limited to such and the disc body can have any shape desired. For example, the shape of the disc body can be triangular, quadrangular, pentagonal, hexagonal, rectangular, and etc. FIGS. 27(A)-(L) are top perspective views of exemplary discs of the applicator brush with different shapes and sizes.

In addition, the number of wire passages (both open and closed passages) is not limited to two. For example, the number of wire passage can be one, two, three, and more. Alternatively, the number of wire passage can be zero. In that case, a plurality of stacked discs are interconnected to one another via ultrasonic method, laser, protrusion/indentation (i.e., LEGO bricks), and etc. Furthermore, those stacked discs can be twisted or untwisted. In addition, it is noted that the disc can be made of any materials including plastic by mono injection molding and bi-injection molding, rubber, silicon and metal.

These and other advantages of the present invention will be apparent to those skilled in the art from the foregoing specification. For example, the present invention provides a cosmetic applicator that is capable of providing excellent mascara makeup effect such as volumizing, curling, separation, and lengthening. In addition, the present invention provides a cosmetic applicator, where each disc has different colors, shapes and sizes, thereby creating a visually attractive cosmetic. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

Additional advantages of the present invention for manufacturing a cosmetic applicator brush with a mono-injection molding are the followings:

The cost of creating a mold is cheaper;

The productivity is drastically improved;

The time to develop new products is reduced;

The manufacturing cost is reduced, thereby capable of providing products with reduced prices to the customers;

It is possible to develop products with various design features and design variations to meet customers' demands;

It is possible to produce products with various sizes;

It is possible to use conventional/widely used mono-injection molding machines;

The cost for molding machine maintenance is reduced, and it is easier to maintain molding machines; and The number of cavity that can be added to the mold is drastically increased.

Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A method for manufacturing a cosmetic applicator brush, the cosmetic applicator brush comprising a plurality of discs assembled relative to one another, each disc having a body with a plurality of bristles extending radially therefrom, comprising the step of:

forming the cosmetic applicator brush by a mono-injection molding, wherein adjacent discs are maintained at an angular relationship with respect to one another independent of a disc specific keying element to show a plurality of design variations of the cosmetic applicator brush, wherein each disc body has a first face with a projection extending therefrom and an opposed second face with an indentation defined therein, wherein the projection and indentation are angularly offset from one another and the interaction of a projection of one disc with the indentation of an adjacent disc maintains the angular relationship between the adjacent discs, wherein angular offset of the projection and the indentation of each disc is between 0° and 360°, and wherein the angular offset is different for at least two of the discs.

2. The method for manufacturing the cosmetic applicator brush according to claim 1, wherein a number of the plurality of bristles is greater than or equal to three.

3. The method for manufacturing the cosmetic applicator brush according to claim 1, wherein the plurality of bristles are placed and extended radially from any positions from each of the plurality of discs.

4. The method for manufacturing the cosmetic applicator brush according to claim 1, wherein each disc body has two wire passages extending therethrough and wire extends through the passages of adjacent discs to link the discs together and an amount of twist in the wire defines the angular relationship between adjacent discs.

5. The method for manufacturing the cosmetic applicator brush according to claim 4, wherein each of the discs has a through bore and a rod extends through the through bore of each of the discs, and wherein the rod and through bore are free of any keying elements.

6. The method for manufacturing the cosmetic applicator brush according to claim 5, wherein the through bores and the rod each have a circular configuration.

7. The method for manufacturing the cosmetic applicator brush according to claim 5, wherein the rod defines a cap end with a finished surface and a connecting surface opposite thereto, the connecting surface defining a projection or a recess configured to engage a recess or projection on a face of an adjacent disc.

8. The method for manufacturing the cosmetic applicator brush according to claim 4, wherein the bristles on adjacent discs define a twisted bristle path.

9. The method for manufacturing the cosmetic applicator brush according to claim 4, wherein at least one bristle includes a main portion and at least one secondary portion extending from the main portion.

10. The method for manufacturing the cosmetic applicator brush according to claim 4, wherein each disc has a body and the bristles are defined by cutting away portions of the body.

11. The method for manufacturing the cosmetic applicator brush according to claim 10, wherein the disc body varies in thickness from a central portion thereof to a circumferential portion thereof.

12. The method for manufacturing the cosmetic applicator brush according to claim 10, wherein the disc body varies in thickness from a central portion thereof to a circumferential portion thereof in a wavy pattern.

13. The method for manufacturing the cosmetic applicator brush according to claim 10, wherein the disc body includes a plurality of bumps and/or recesses defined thereon.

14. The method for manufacturing the cosmetic applicator brush according to claim 4, wherein a number of twist is between 2 and 60.

15. The method for manufacturing the cosmetic applicator brush according to claim 1, wherein the interaction of the projection of one disc with the indentation of an adjacent disc maintains the adjacent discs interconnected to form a brush head.

16. The method for manufacturing the cosmetic applicator brush according to claim 15, wherein the discs are further secured to one another via welding and/or gluing.

17. The method for manufacturing the cosmetic applicator brush according to claim 1, wherein the plurality of bristles further comprise one or more branches with different sizes.

18. The method for manufacturing the cosmetic applicator brush according to claim 1, wherein the plurality of bristles does not comprise any branches.

19. The method for manufacturing the cosmetic applicator brush according to claim 1, wherein each of the plurality of bristles has different dimensions.

20. The method for manufacturing the cosmetic applicator brush according to claim 1, wherein each of the plurality of discs has different shapes and sizes.

* * * * *